US007032553B2

(12) United States Patent
Williams et al.

(10) Patent No.: US 7,032,553 B2
(45) Date of Patent: Apr. 25, 2006

(54) VALVE OPERATING ASSEMBLY

(75) Inventors: Carroll Williams, Pocahontas, AR (US); Dhruva Mandal, Vernon Hills, IL (US)

(73) Assignee: The MacLean-Fogg Company, Mundelein, IL (US)

( * ) Notice: Subject to any disclaimer, the term of this patent is extended or adjusted under 35 U.S.C. 154(b) by 0 days.

(21) Appl. No.: 11/107,580

(22) Filed: Apr. 15, 2005

(65) Prior Publication Data

US 2005/0199206 A1 Sep. 15, 2005

Related U.S. Application Data

(63) Continuation of application No. 10/316,264, filed on Oct. 18, 2002.

(51) Int. Cl.
*F01L 1/14* (2006.01)

(52) U.S. Cl. ..... 123/90.48; 123/90.45; 123/90.52

(58) Field of Classification Search ..... 123/90.45, 123/90.52, 90.48
See application file for complete search history.

(56) References Cited

U.S. PATENT DOCUMENTS 4,741,298 A * 5/1988 Rhoads ..... 123/90.5

OTHER PUBLICATIONS

MF 02716 Labelled to show the different surfaces.*
Print, Jul. 16, 2001 01519.
Prints, Nov. 22, 2000 01521.
Print, Jul. 17, 2001 01523.
Print, Jun. 21, 1999 01525.
Print, Jul. 16, 2001 01527.
Print, Sep. 10, 1985 02433.
Print, Jun. 6, 1985 02491.
Print, Jan. 26, 1989 02524.
Print, Aug. 4, 1988 02769.
Print, Jun. 27, 1986 02848.
Print, Jul. 15, 1988 03264.
Print, Jul. 25, 19856 03312.
Print, Jan. 6, 1986 03360.
Print, Jan. 29, 1986 03478.
Print, Dec. 4, 1984 03716.

(Continued)

*Primary Examiner*—Thomas Denion
*Assistant Examiner*—Zelalem Eshete
(74) *Attorney, Agent, or Firm*—Dana Andrew Alden

(57) ABSTRACT

The present invention relates to an assembly, comprising an adjusting body, a valve lifter body and means for cold forming at least a portion of at least one of the adjusting body and the valve lifter body. The adjusting body includes an outer surface enclosing a cavity, wherein the cavity includes an inner surface configured to accommodate an insert and a spring. The valve lifter body includes a first end containing a first opening, a second end containing a second opening, and an outer lifter surface that encloses a first and second lifter cavity, wherein at least one of the ends is substantially flat, the second lifter cavity includes a second inner lifter surface that is configured to house the adjusting body, and the first cavity is configured to house a cylindrical insert and includes a first inner lifter surface provided with a plurality of walls that extend from the first opening, a curved surface, a flat surface, and an angled surface that is at an angle with respect to the flat surfaces.

22 Claims, 47 Drawing Sheets

OTHER PUBLICATIONS

Prints, Apr. 11, 1990 03740-03741.
Print, Dec. 10, 1984 03753.
Print, Dec. 3, 1985 03758.
Prints, Jan. 29, 1981 03820-03821.
Print, Jan. 2, 1985 03929.
Print, Sep. 5, 1985 03936.
Print, Feb. 24, 1989 03987.
Print, Jun. 23, 1986 04021.
Print, Dec. 4, 1984 04050.
Print, Aug. 16, 2001 04075.
Prints, Sep. 11, 2001 01755-01763.
Print, May 2, 1986 03942.

* cited by examiner

VALVE OPERATING ASSEMBLY

This application is a continuation of prior application Ser. No. 10/316,264, filed Oct. 18, 2002. The disclosure of application Ser. No. 10/316,264 is hereby incorporated herein by reference.

FIELD OF THE INVENTION

This invention relates to adjusting bodies, and particularly to adjusting bodies used in combustion engines.

BACKGROUND OF THE INVENTION

Adjusting bodies are known in the art and are used in camshaft internal combustion engines. Adjusting bodies open and close valves that regulate fuel and air intake. As noted in U.S. Pat. No. 6,328,009 to Brothers, the disclosure of which is hereby incorporated herein by reference, Adjusting bodies are typically fabricated through machining. Col. 8, ll. 1–3. However, machining is inefficient, resulting in increased labor and decreased production.

The present invention is directed to overcoming this and other disadvantages inherent in prior-art lifter bodies.

SUMMARY OF THE INVENTION

The scope of the present invention is defined solely by the appended claims, and is not affected to any degree by the statements within this summary. Briefly stated, the present invention relates to an adjusting body, comprising an outer surface, enclosing a cavity, wherein the cavity includes an inner surface configured to accommodate an insert and a spring; and the cavity is fabricated through forging.

BRIEF DESCRIPTION OF THE DRAWINGS

FIGS. 50–54 depict a preferred method of fabricating a socket.

DETAILED DESCRIPTION OF THE PRESENTLY PREFERRED EMBODIMENTS

Figure 1:
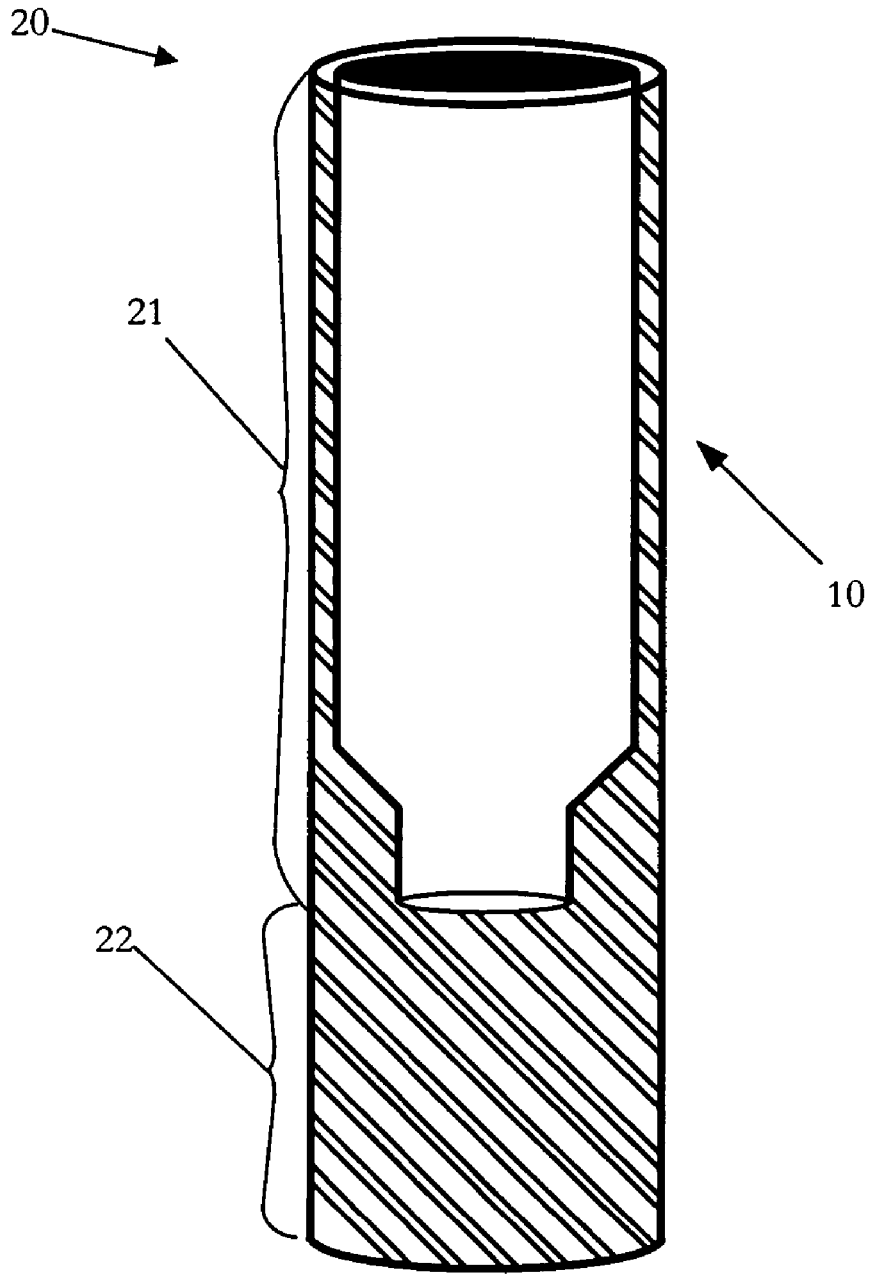
FIG. 1 depicts a preferred embodiment of an adjusting body.
Figure 2:
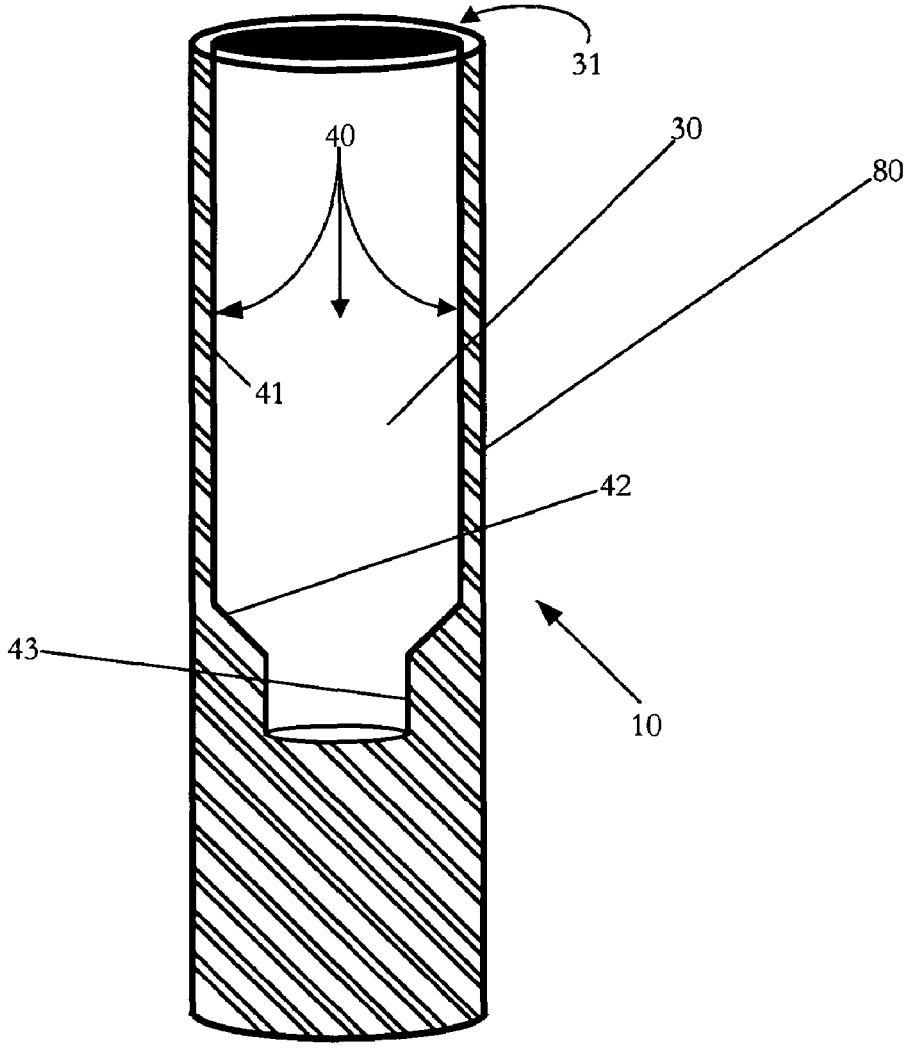
FIG. 2 depicts a preferred embodiment of an adjusting body.
Figure 3:
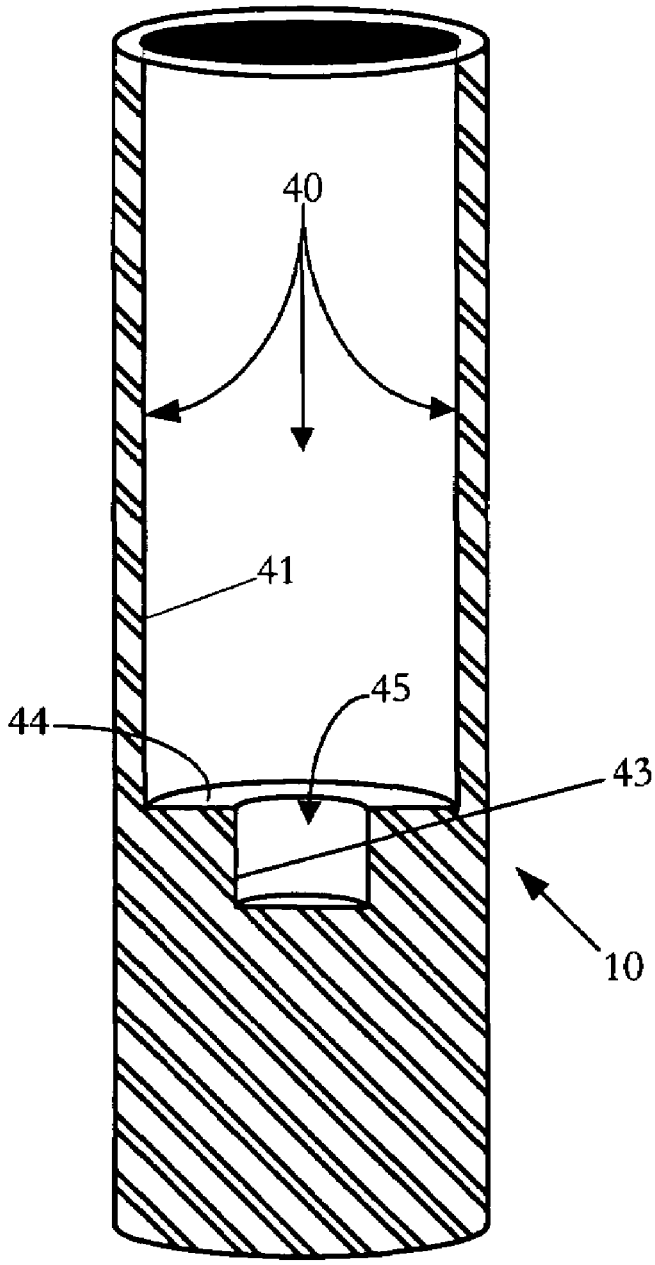
FIG. 3 depicts the top view of a preferred embodiment of an adjusting body.

Turning now to the drawings, FIGS. 1, 2, and 3 show an adjusting body 10 of the preferred embodiment of the present invention. The adjusting body 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the adjusting body 10 is composed of pearlitic material. According to still another aspect of the present invention, the adjusting body 10 is composed of austenitic material. According to another aspect of the present invention, the metal is a ferritic material.

The body 20 is composed of a plurality of shaft elements. According to one aspect of the present invention, the shaft element is cylindrical in shape. According to another aspect of the present invention, the shaft element is conical in shape. According to yet another aspect of the present invention, the shaft element is solid. According to still another aspect of the present invention, the shaft element is hollow.

FIG. 1 depicts a cross-sectional view of the body 20 composed of a plurality of shaft elements. FIG. 1 shows the body, generally designated 20. The body 20 of the preferred embodiment is fabricated from a single piece of metal wire or rod and is described herein as a plurality of shaft elements. The body 20 includes a hollow shaft element 21 and a solid shaft element 22. In the preferred embodiment, the solid shaft element 22 is located adjacent to the hollow shaft element 21.

The body 20 functions to accommodate a plurality of inserts. According to one aspect of the present invention, the body 20 accommodates a leakdown plunger, such as that disclosed in "Leakdown Plunger," application Ser. No. 10/274,519, filed on Oct. 18, 2002, the disclosure of which is hereby incorporated herein by reference. In the preferred embodiment, the body 20 accommodates a leakdown plunger 210. According to another aspect of the present invention, the body 20 accommodates a push rod seat (not shown). According to yet another aspect of the present invention, the body 20 accommodates a metering socket such as that disclosed in "Metering Socket," application Ser. No. 10/316,262, filed on Oct. 18, 2002, the disclosure of which is hereby incorporated herein by reference. In the preferred embodiment, the body 20 accommodates a socket 310.

Figure 7:
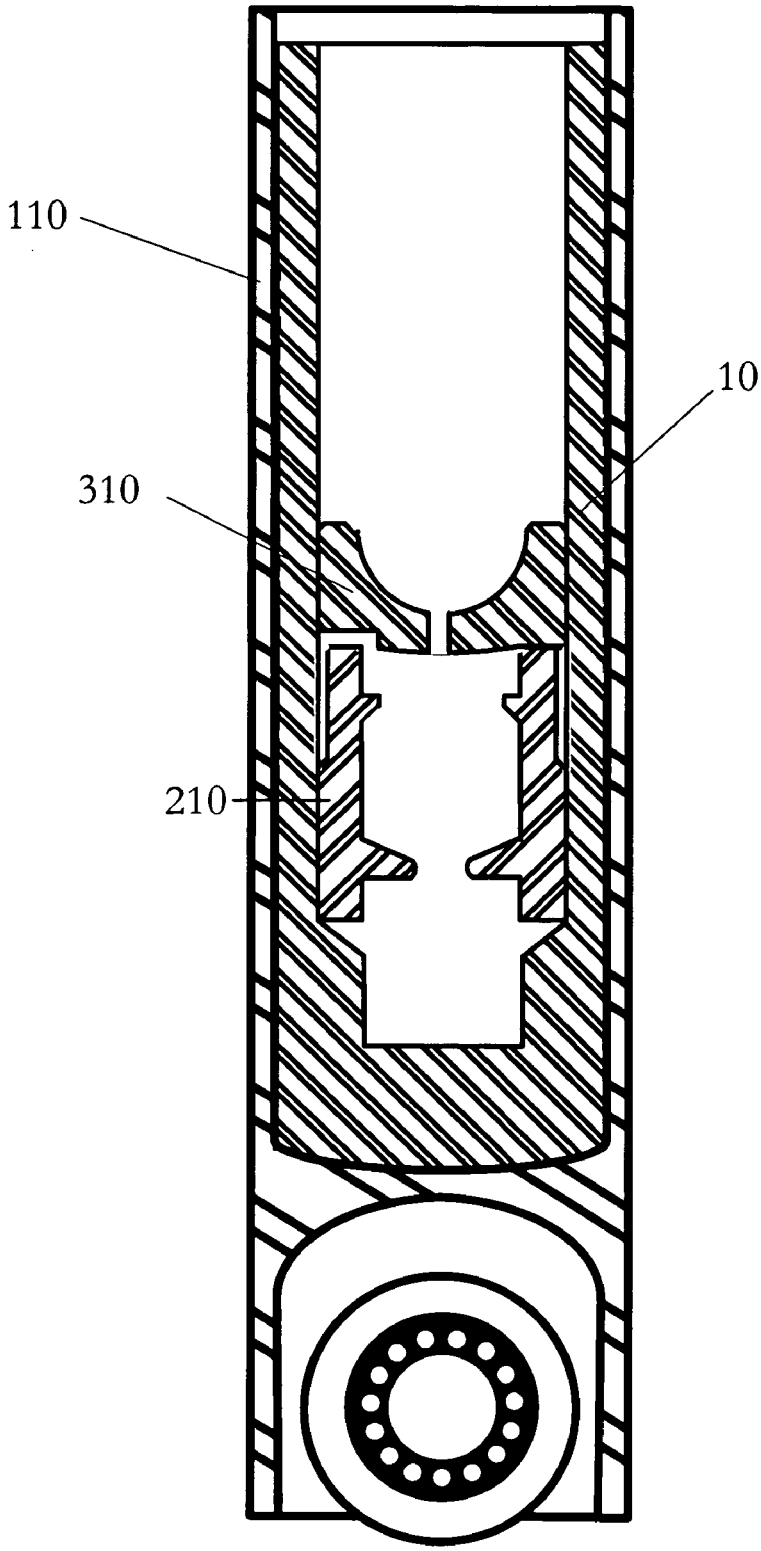
FIG. 7 depicts an adjusting body, a valve lifter body, a leakdown plunger, and a socket of the presently preferred embodiment.

The body 20 is provided with a plurality of outer surfaces and inner surfaces. FIG. 2 depicts a cross-sectional view of the body 20 of the preferred embodiment of the present invention. As shown in FIG. 2, the body 20 is provided with an outer surface 80 which is configured to be inserted into another body. According to one aspect of the present invention, the outer surface 80 is configured to be inserted into a roller lifter body such as that disclosed in Applicants' "Valve Lifter Body," application Ser. No. 10/316,263, filed on Oct. 18, 2002, the disclosure of which is incorporated herein by reference. According to another aspect of the present invention, the outer surface 80 is configured to be inserted into a roller follower such as that disclosed in Applicants' "Roller Follower Body," application Ser. No. 10/316,261, filed on Oct. 17, 2002. In the preferred embodiment, as shown in FIG. 7, the outer surface 80 is configured to be inserted into the valve lifter body 110.

The outer surface 80 encloses a plurality of cavities. As depicted in FIG. 2, the outer surface 80 encloses a cavity 30. The cavity 30 is configured to cooperate with a plurality of inserts. According to one aspect of the present invention, the cavity 30 is configured to cooperate with a leakdown plunger, preferably the leakdown plunger 210. According to another aspect of the present invention, the cavity 30 is configured to cooperate with a metering socket, preferably the socket 310. According to yet another aspect of the present invention, the cavity 30 is configured to cooperate with a push rod. According to still yet another aspect of the present invention, the cavity is configured to cooperate with a push rod seat.

Referring to FIG. 2, the body 20 of the present invention is provided with a cavity 30 that includes an opening 31. The opening 31 is in a circular shape. The cavity 30 is provided with an inner surface 40.

The inner surface 40 includes a plurality of surfaces. According to one aspect of the present invention, the inner surface 40 includes a cylindrical surface. According to another aspect of the present invention, the inner surface 40 includes a conical or frustoconical surface.

As depicted in FIG. 2, the inner surface 40 is provided with a first cylindrical surface 41, preferably concentric relative to the outer surface 80. Adjacent to the first cylindrical surface 41 is a conical surface 42. Adjacent to the conical surface 42 is a second cylindrical surface 43. However, those skilled in the art will appreciate that the inner surface 40 can be fabricated without the conical surface 42.

Figure 49:
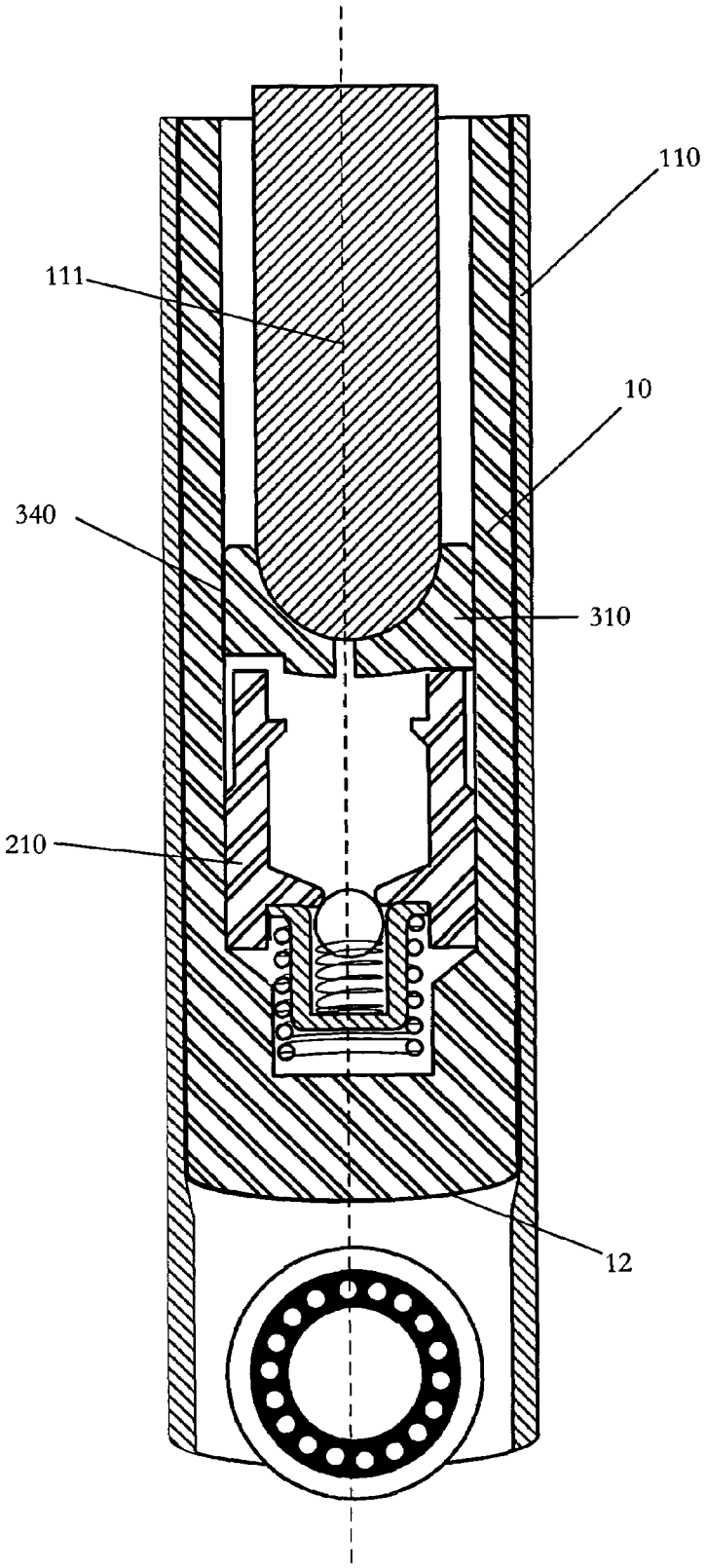
FIG. 49 depicts an embodiment of a socket cooperating with an engine work piece.

FIG. 3 depicts a cut-away view of the body 20 of another embodiment. The body 20 is provided with an axis 11 depicted as a dashed line designated "11" on FIG. 3 and a bottom surface 12 located on the outer surface 80 at the end of the body 20. The inner surface 40 is provided with a first cylindrical surface 41 that includes a first inner diameter 184. The first cylindrical surface 41 abuts an annular surface 44 with an annulus 45. The annulus 45 abuts and defines a second cylindrical surface 43 that includes a second inner diameter 85. In the embodiment depicted, the second inner diameter 85 is smaller than the first inner diameter 84. The annular surface 44 and the bottom surface 12 are oriented to be orthogonal to the axis 11 of the body 20, and when the body 20 is inserted into a valve lifter body 110 (as represented in FIG. 7 and FIG. 49) the annular surface 44 and the bottom surface 12 are oriented to be orthogonal to the axis of the valve lifter body 110 (referred to herein as a "valve lifter axis 111").

The body 20 of the present invention is fabricated through a plurality of processes. According to one aspect of the present invention, the body 20 is machined. According to another aspect of the present invention, the body 20 is forged. According to yet another aspect of the present invention, the body 20 is fabricated through casting. The preferred embodiment of the present invention is forged. As used herein, the term "forge," "forging," or "forged" is intended to encompass what is known in the art as "cold forming," "cold heading," "deep drawing," and "hot forging."

The preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The cavity 30 is extruded through use of a punch and an extruding pin. After the cavity 30 has been extruded, the cavity 30 is forged. The cavity 30 is extruded through use of an extruding punch and a forming pin.

Alternatively, the body 20 is fabricated through machining. As used herein, machining means the use of a chucking machine, a drilling machine, a grinding machine, or a broaching machine. Machining is accomplished by first feeding the body 20 into a chucking machine, such as an ACME-Gridley automatic chucking machine. Those skilled in the art will appreciate that other machines and other manufacturers of automatic chucking machines can be used.

To machine the cavity 30, the end containing the opening 31 is faced so that it is substantially flat. The cavity 30 is bored. Alternatively, the cavity 30 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the cavity 30 is ground using an internal diameter grinding machine, such as a Heald grinding machine. Those skilled in the art will appreciate that the cavity 30 can be ground using other grinding machines.

Figure 4:
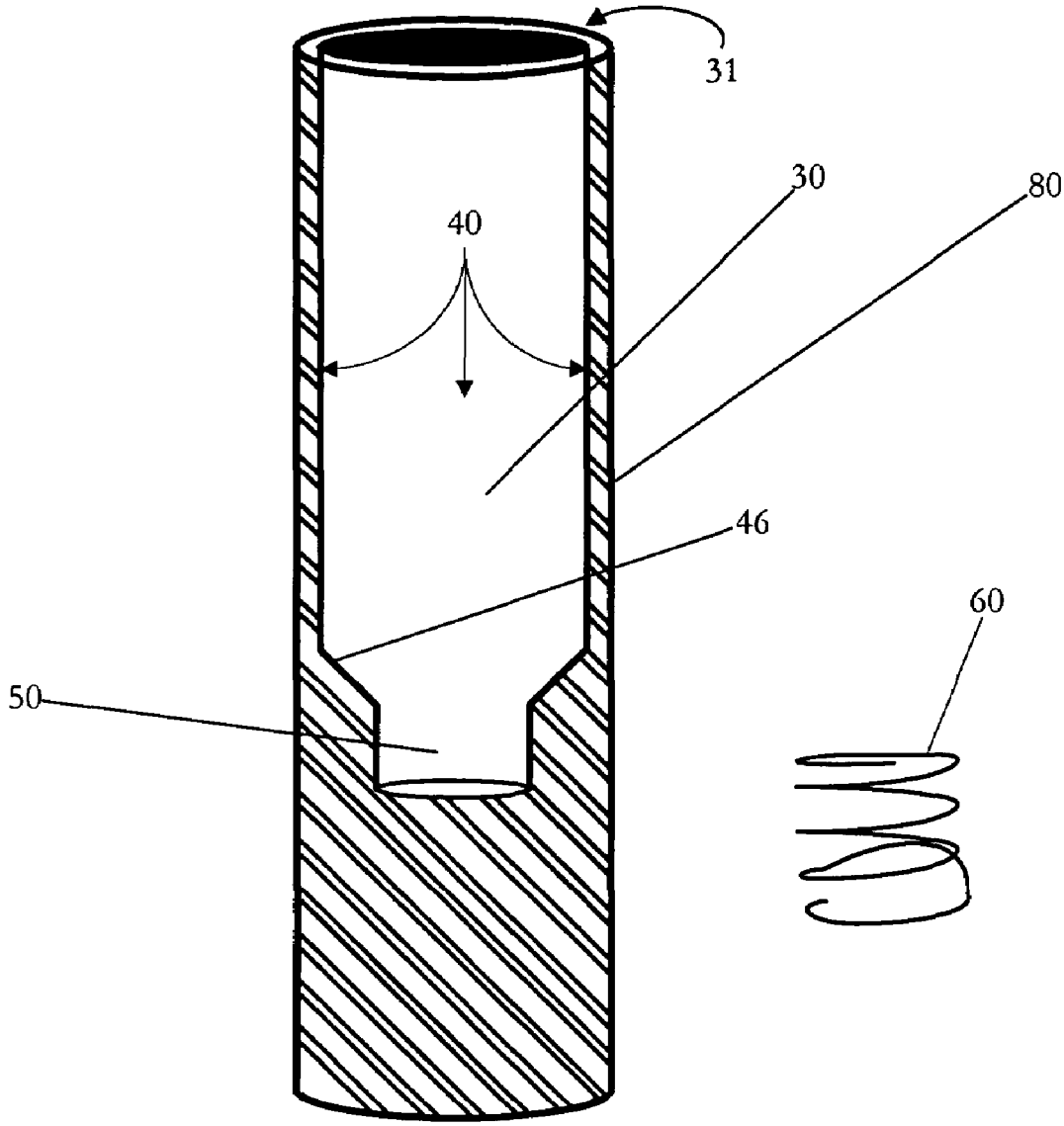
FIG. 4 depicts the top view of another preferred embodiment of an adjusting body.

FIG. 4 depicts the inner surface 40 provided with a well 50. The well 50 is shaped to accommodate a spring 60. In the embodiment depicted in FIG. 4, the well 50 is cylindrically shaped at a diameter that is smaller than the diameter of the inner surface 40. The cylindrical shape of the well 50 is preferably concentric relative to the outer surface 80. The well 50 is preferably forged through use of an extruding die pin.

Alternatively, the well 50 is machined by boring the well 50 in a chucking machine. Alternatively, the well 50 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the well 50 is ground using an internal diameter grinding machine, such as a Heald grinding machine. Those skilled in the art will appreciate that the well 50 can be ground using other grinding machines.

Adjacent to the well 50, the embodiment depicted in FIG. 4 is provided with a conically-shaped lead surface 46 which can be fabricated through forging or machining. However, those skilled in the art will appreciate that the present invention can be fabricated without the lead surface 46.

Figure 5:
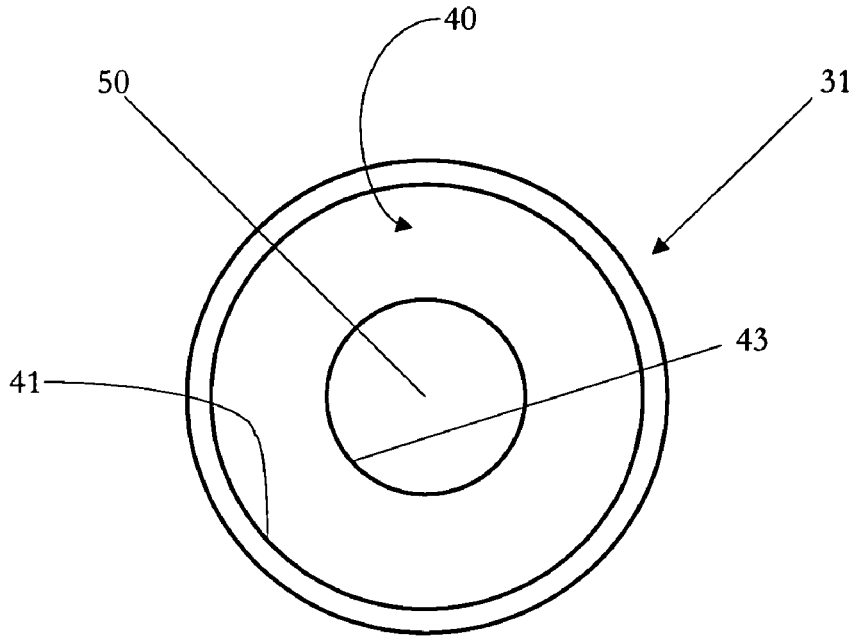
FIG. 5 depicts a second embodiment of an adjusting body.

FIG. 5 depicts a view of the opening 31 that reveals the inner surface 40 of an embodiment. The inner surface 40 is provided with a first cylindrical surface 41. The well 50 is defined by a second cylindrical surface 43. As shown in FIG. 5, the second cylindrical surface 43 is concentric relative to the first cylindrical surface 41.

Figure 6:
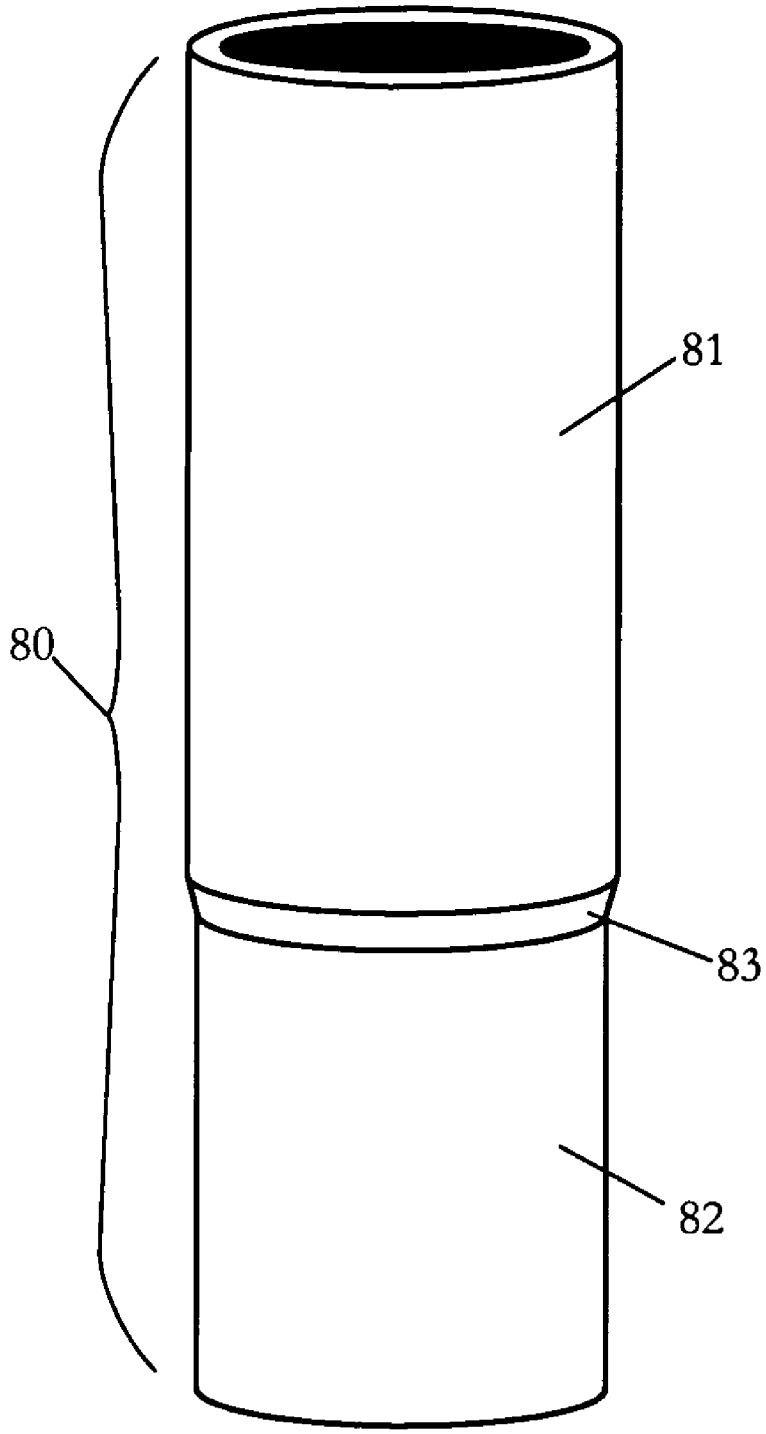
FIG. 6 depicts the top view of another preferred embodiment of an adjusting body.

Depicted in FIG. 6 is another alternative embodiment. As shown in FIG. 6, the body 20 is provided with an outer surface 80. The outer surface 80 includes a plurality of surfaces. In the embodiment depicted in FIG. 6, the outer surface 80 includes a cylindrical surface 81, an undercut surface 82, and a conical surface 83. As depicted in FIG. 6, the undercut surface 82 extends from one end of the body 20 and is cylindrically shaped. The diameter of the undercut surface 82 is smaller than the diameter of the cylindrical surface 81.

The undercut surface 82 is preferably forged through use of an extruding die. Alternatively, the undercut surface 82 is fabricated through machining. Machining the undercut surface 82 is accomplished through use of an infeed centerless grinding machine, such as a Cincinnati grinder. The surface is first heat-treated and then the undercut surface 82 is ground via a grinding wheel. Those skilled in the art will appreciate that additional surfaces can be ground into the outer surface with minor alterations to the grinding wheel.

As depicted in FIG. 6, the conical surface 83 is located between the cylindrical surface and the undercut surface. The conical surface 83 is preferably forged through use of an extruding die. Alternatively, the conical surface 83 is fabricated through machining. Those with skill in the art will appreciate that the outer surface 80 can be fabricated without the conical surface 83 so that the cylindrical surface 81 and the undercut surface 82 abut one another.

Those skilled in the art will appreciate that the features of the adjusting body 10 may be fabricated through a combination of machining, forging, and other methods of fabrication. By way of example and not limitation, aspects of the cavity 30 can be machined; other aspects of the cavity can be forged.

Turning now to FIG. 7, the lash adjuster body 10 is shown located within another body. As depicted therein, the lash adjuster body 10 is preferably located within a valve lifter body 110.

Figure 8:
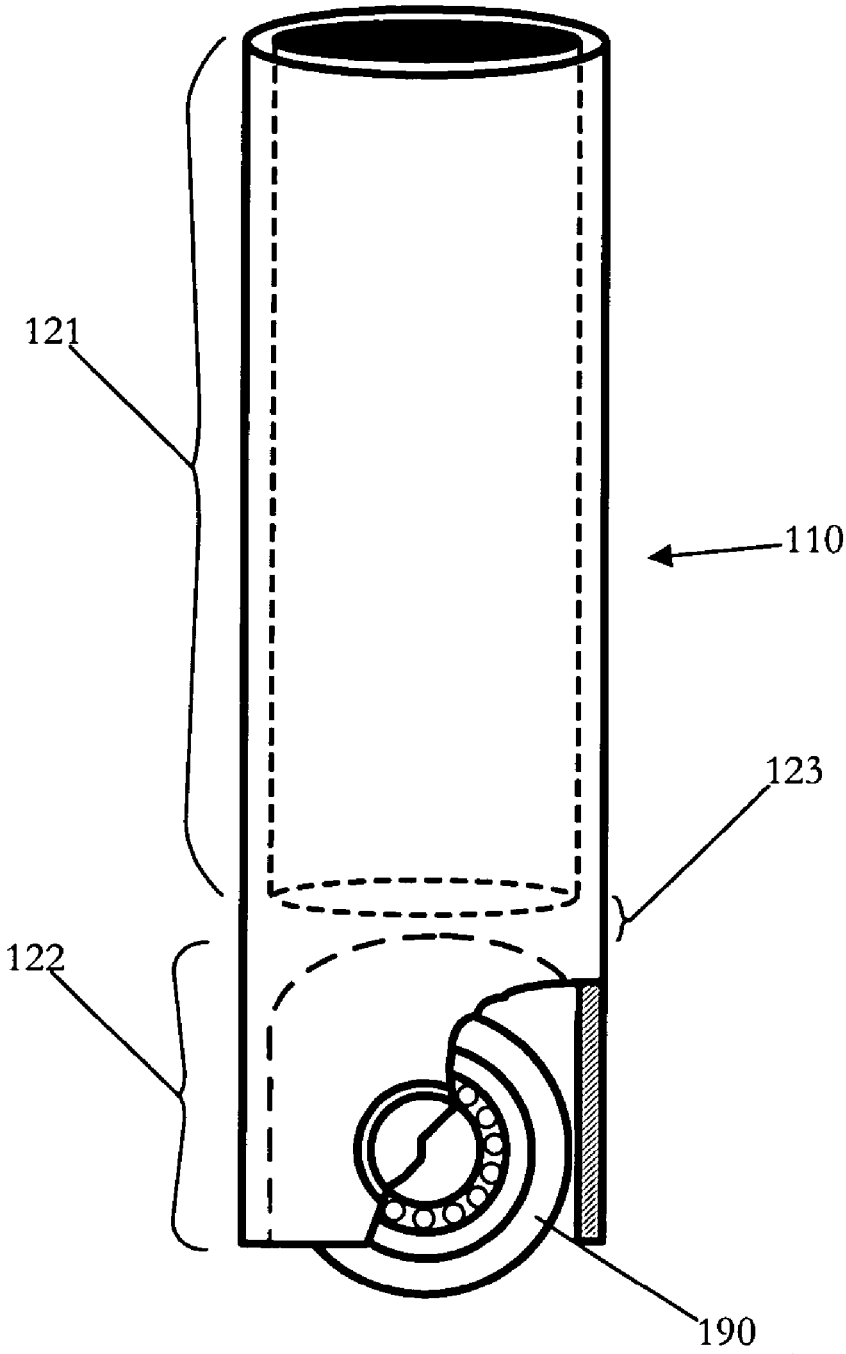
FIG. 8 depicts a preferred embodiment of a valve lifter body.
Figure 9:
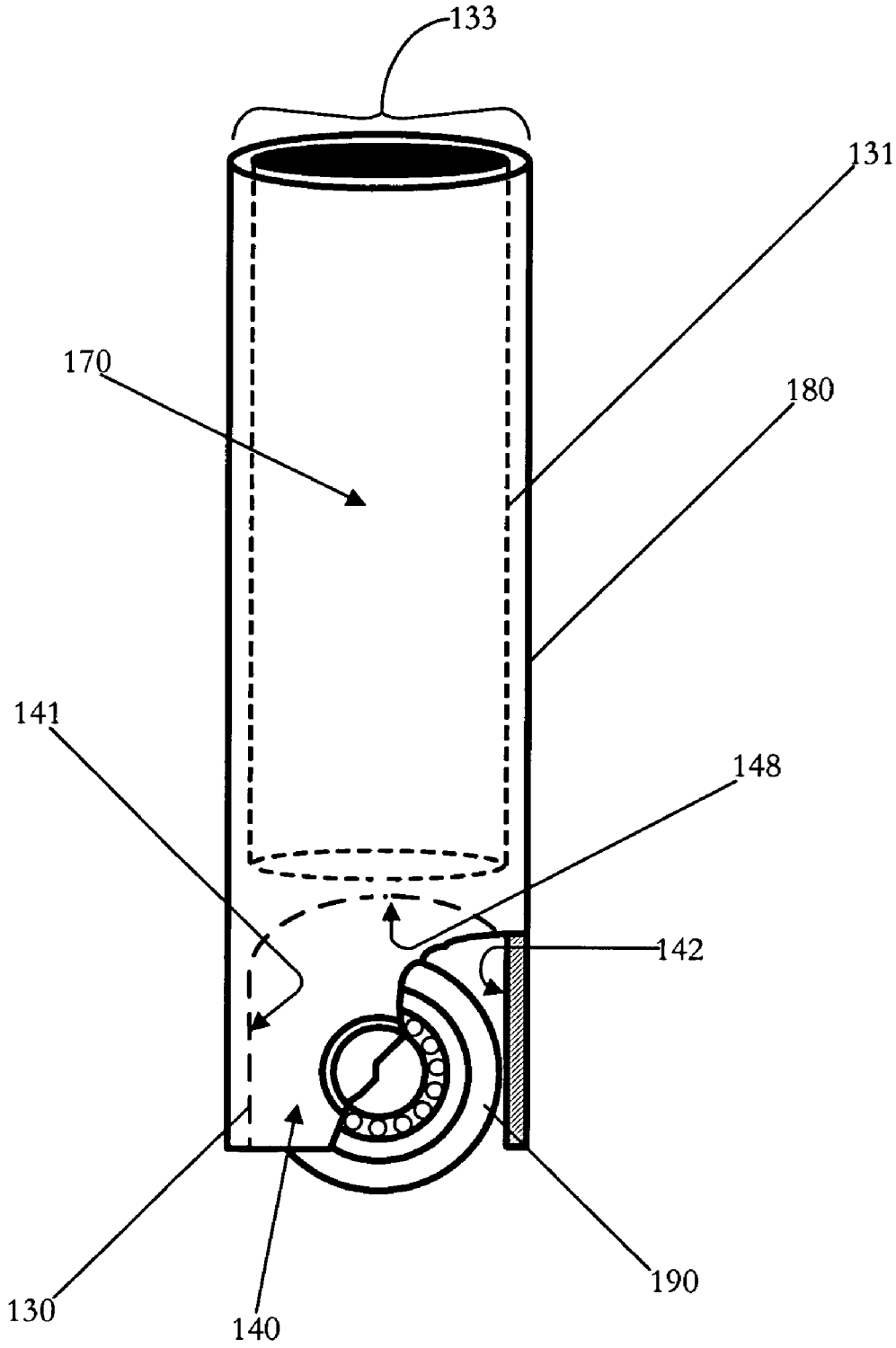
FIG. 9 depicts a preferred embodiment of a valve lifter body.
Figure 10:
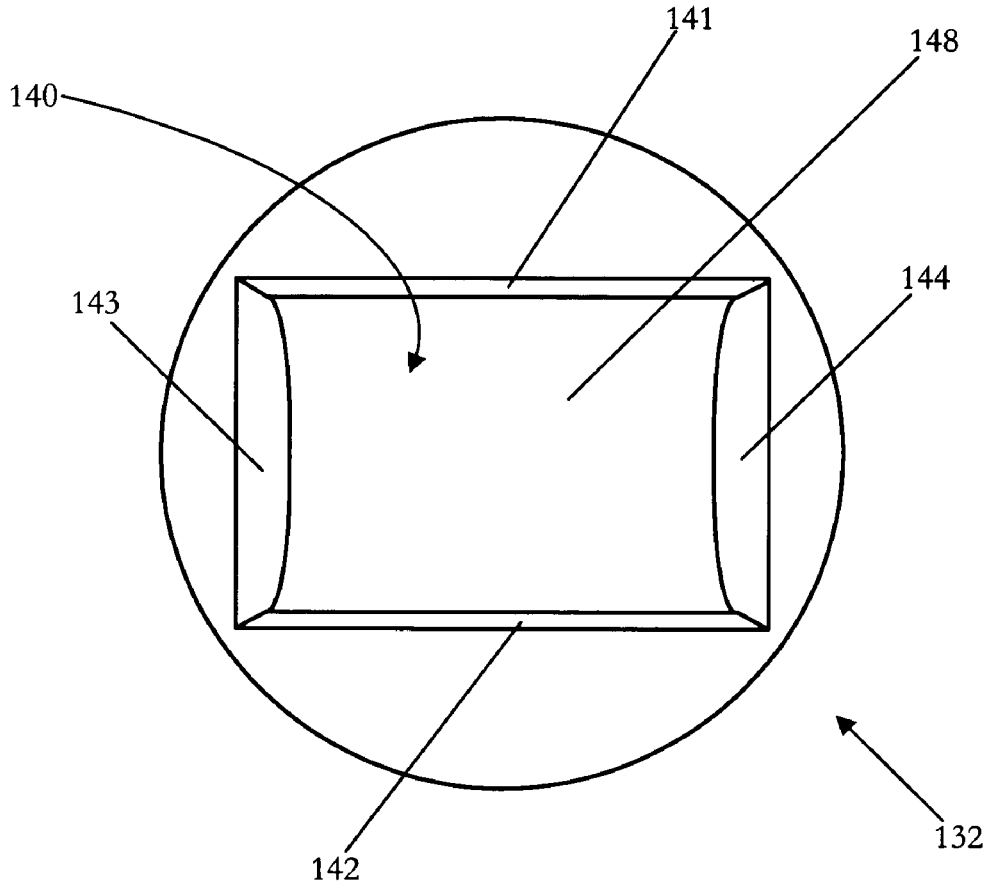
FIG. 10 depicts the top view of a preferred embodiment of a valve lifter body.

FIGS. 8, 9, and 10 show the valve lifter body 110 of the preferred embodiment. The valve lifter body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter body 110 is composed of pearlitic material. According to still another aspect of the present invention, the valve lifter body 110 is composed of austenitic material. According to another aspect of the present invention, the metal is a ferritic material.

The valve lifter body 110 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 8 depicts a cross-sectional view of the valve lifter body 110 of the preferred embodiment of the present invention composed of a plurality of lifter elements. FIG. 8 shows the valve lifter body, generally designated 110, with a roller 190. The valve lifter body 110 of the preferred embodiment is fabricated from a single piece of metal wire or rod and is described herein as a plurality of lifter elements. The valve lifter body 110 includes a first hollow lifter element 121, a second hollow lifter element 122, and a solid lifter element 123. In the preferred embodiment, the solid lifter element 123 is located between the first hollow lifter element 121 and the second hollow lifter element 122.

The valve lifter body 110 functions to accommodate a plurality of inserts. According to one aspect of the present invention, the valve lifter body 110 accommodates a lash adjuster body, such as the adjusting body 10. According to another aspect of the present invention, the valve lifter body 110 accommodates a leakdown plunger, such as the leakdown plunger 210. According to another aspect of the present invention, the valve lifter body 110 accommodates a push rod seat (not shown). According to yet another aspect of the present invention, the valve lifter body 110 accommodates a socket, such as the metering socket 10.

The valve lifter body 110 is provided with a plurality of outer surfaces and inner surfaces. FIG. 9 depicts a cross-sectional view of the valve lifter body 110 of the preferred embodiment of the present invention. As shown in FIG. 9, the valve lifter body 110 is provided with an outer lifter surface 180 which is cylindrically shaped. The outer lifter surface 180 encloses a plurality of cavities. As depicted in FIG. 9, the outer lifter surface 180 encloses a first lifter cavity 130 and a second lifter cavity 131. The first lifter cavity 130 includes a first inner lifter surface 140. The second lifter cavity 131 includes a second inner lifter surface 170.

FIG. 10 depicts a top view and provides greater detail of the first lifter cavity 130 of the preferred embodiment. As shown in FIG. 10, the first lifter cavity 130 is provided with a first lifter opening 132 shaped to accept a cylindrical insert. The first inner lifter surface 140 is configured to house a cylindrical insert 190, which, in the preferred embodiment of the present invention, functions as a roller. Those skilled in the art will appreciate that housing a cylindrical insert can be accomplished through a plurality of different configurations. The first inner lifter surface 140 of the preferred embodiment includes a plurality of flat surfaces and a plurality of walls. As depicted in FIG. 10, the inner lifter surface 140 includes two opposing lifter walls referred to herein as a fourth wall 143 and a third wall 144. A first wall 141 is adjacent to a curved lifter surface 148. The curved lifter surface 148 is adjacent to a second wall 142. The two lifter walls 143, 144 are located on opposing sides of the curved lifter surface 148.

Figure 19:
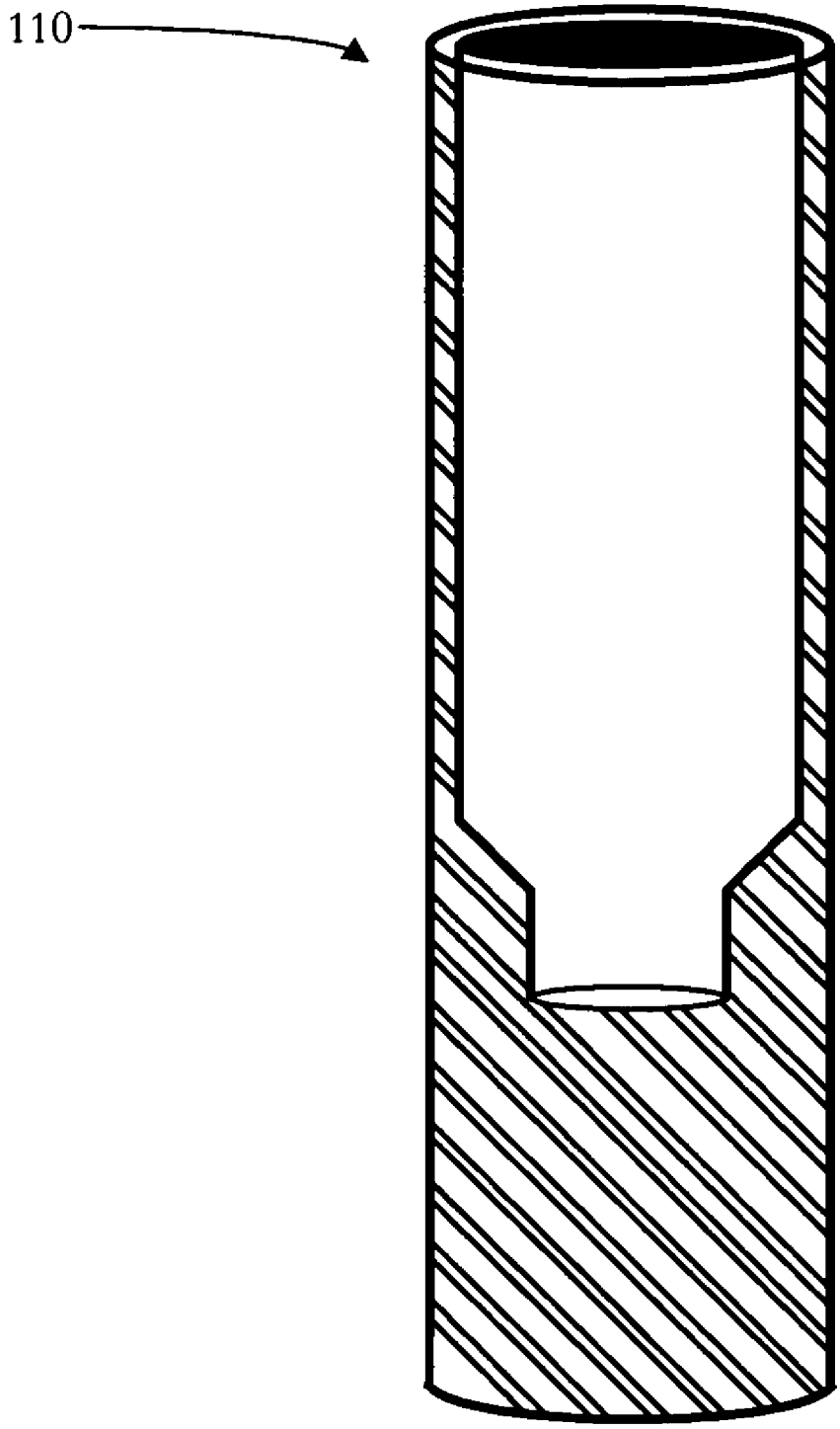
FIG. 19 depicts an adjusting body.

Referring to FIG. 9, the valve lifter body 110 of the present invention is provided with a second lifter cavity 131 which includes a second lifter opening 133 which is in a circular shape. The second lifter cavity 131 is provided with a second inner lifter surface 170. The second inner lifter surface 170 of the preferred embodiment is cylindrically shaped. Alternatively, the second inner lifter surface 170 is configured to house an adjusting body, generally designated 10 on FIG. 19. However, those skilled in the art will appreciate that the second inner lifter surface 170 can be conically or frustoconically shaped without departing from the spirit of the present invention.

The present invention is fabricated through a plurality of processes. According to one aspect of the present invention, the valve lifter body 110 is machined. According to another aspect of the present invention, the valve lifter body 110 is forged. According to yet another aspect of the present invention, the valve lifter body 110 is fabricated through casting. The valve lifter body 110 of the preferred embodiment of the present invention is forged. As used herein, the term "forge," "forging," or "forged" is intended to encompass what is known in the art as "cold forming," "cold heading," "deep drawing," and "hot forging."

The valve lifter body 110 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 110 preferably begins with a metal wire or metal rod which is drawn to size. The ends of the wire or rod are squared off by a punch. After being drawn to size, the wire or rod is run through a series of dies or extrusions. The second lifter cavity 131 is extruded through use of a punch and an extruding pin. After the second lifter cavity 131 has been extruded, the first lifter cavity 130 is forged. The first lifter cavity 130 is extruded through use of an extruding punch and a forming pin.

Alternatively, the valve lifter body 110 is fabricated through machining. As used herein, machining means the use of a chucking machine, a drilling machine, a grinding machine, or a broaching machine. Machining is accomplished by first feeding the valve lifter body 110 into a chucking machine, such as an ACME-Gridley automatic chucking machine. Those skilled in the art will appreciate that other machines and other manufacturers of automatic chucking machines can be used.

To machine the second lifter cavity 131, the end containing the second lifter opening 133 is faced so that it is substantially flat. The second lifter cavity 131 is bored. Alternatively, the second lifter cavity 131 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 131 is ground using an internal diameter grinding machine, such as a Heald grinding machine. Those skilled in the art will appreciate that the second lifter cavity 131 can be ground using other grinding machines.

Those skilled in the art will appreciate that the other features of the present invention may be fabricated through machining. For example, the first lifter cavity 130 can be machined. To machine the first lifter cavity 130, the end containing the first lifter opening 132 is faced so that it is substantially flat. The first lifter cavity 130 is drilled and then the first lifter opening 132 is broached using a broaching machine.

Figure 11:
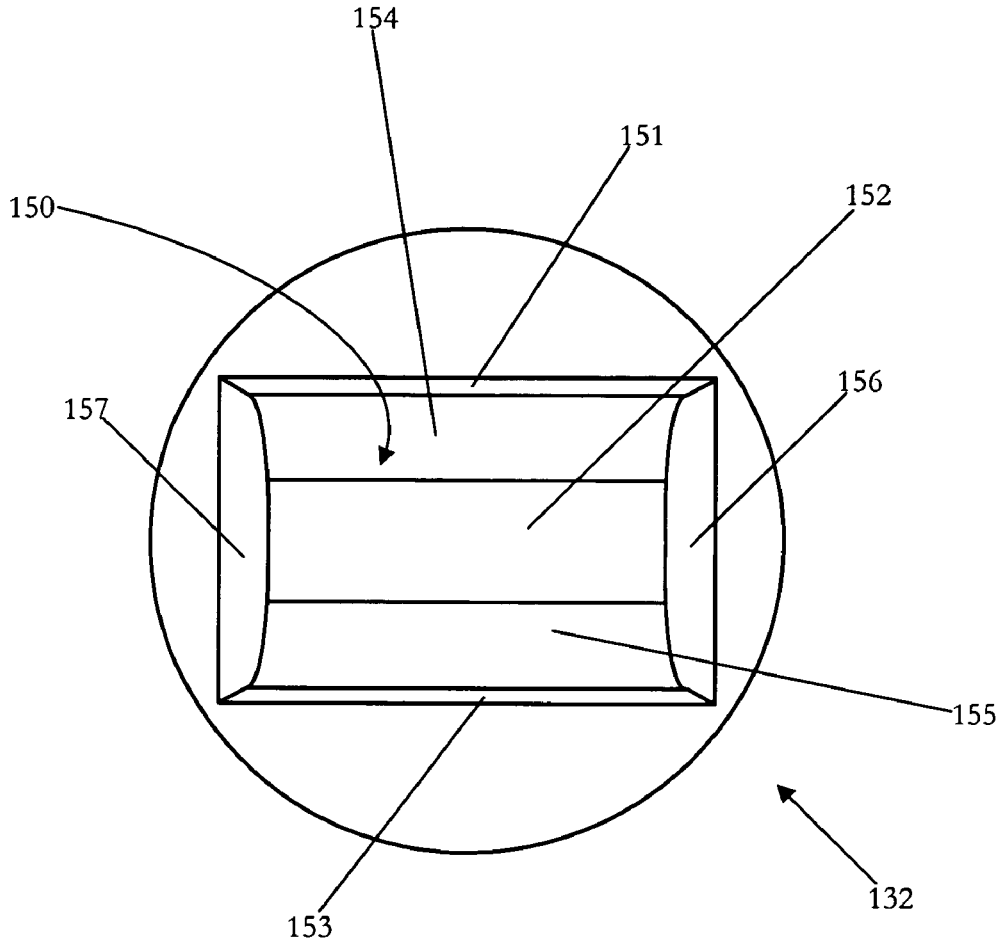
FIG. 11 depicts the top view of another preferred embodiment of a valve lifter body.

In an alternative embodiment of the present invention depicted in FIG. 11, the first lifter cavity 130 is provided with a first lifter opening 132 shaped to accept a cylindrical insert and a first inner lifter surface 150. The first inner lifter surface 150 includes a flat surface, a plurality of curved surfaces, and a plurality of walls, referred to herein as a first wall 151, a second wall 153, a third wall 156, and a fourth wall 157. As depicted in FIG. 11, the first wall 151 is adjacent to a first curved lifter surface 154. The first curved lifter surface 154 is adjacent to a lifter surface 152. The lifter surface 152 is adjacent to a second curved lifter surface 155. The second curved lifter surface 155 is adjacent to the second wall 153.

Figure 12:
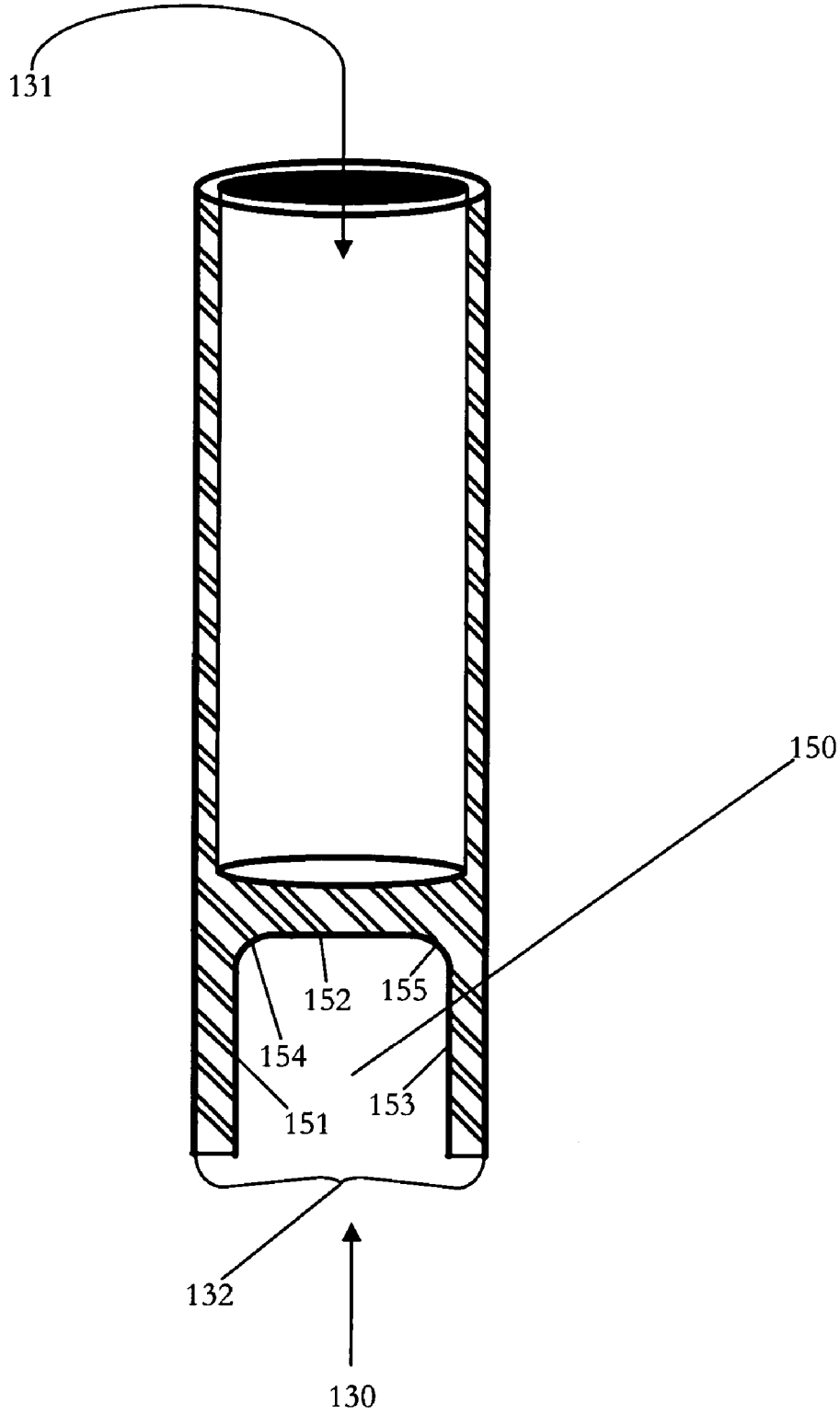
FIG. 12 depicts a second embodiment of a valve lifter body.

As depicted in FIG. 11, the third wall 156 and the fourth wall 157 are located on opposing sides of the second wall 153. FIG. 12 depicts a cross-sectional view of the valve lifter body 110 with the first lifter cavity 130 shown in FIG. 11. As shown in FIG. 12, the lifter surface 152 is, relative to the first and second curved lifter surfaces 154, 155, generally flat in shape and oriented to be orthogonal to the valve lifter axis 111 of the valve lifter body 110.

Figure 13:
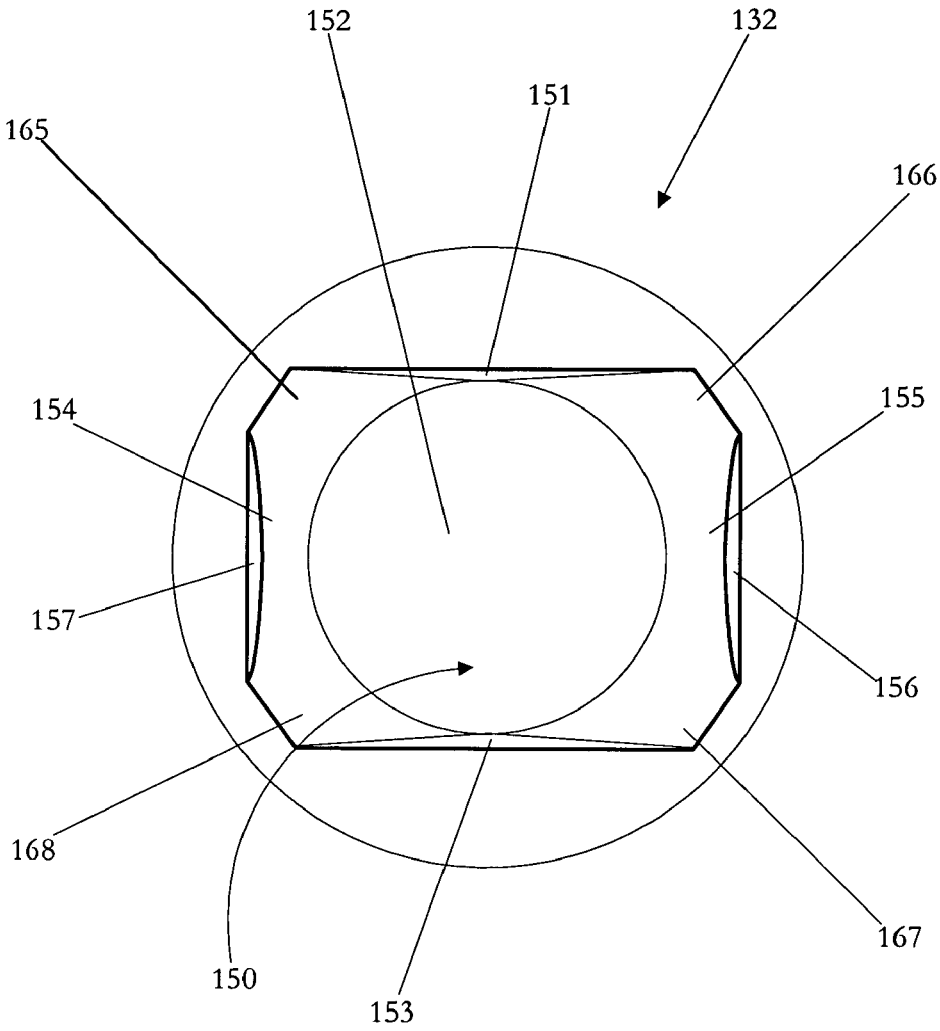
FIG. 13 depicts the top view of another preferred embodiment of a valve lifter body.
Figure 14:
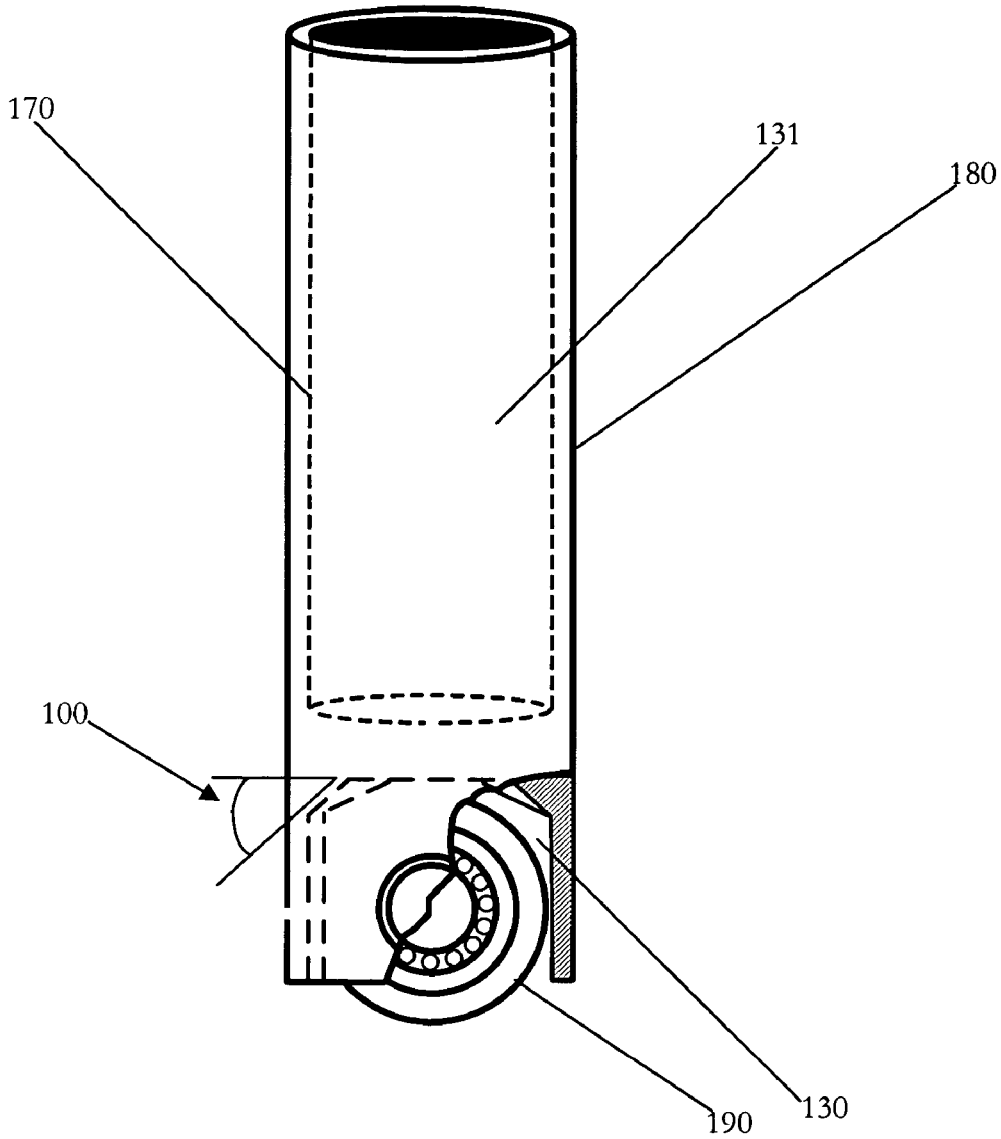
FIG. 14 depicts a third embodiment of a valve lifter body.

In another alternative embodiment of the present invention, as depicted in FIG. 13 and 49, the first lifter cavity 130 is provided with a first lifter opening 132 shaped to accept a cylindrical insert and a first inner lifter surface 150. The first inner lifter surface 150 includes a plurality of walls referred to herein as as first wall 151, a second wall 153, a third wall 156, and a fourth wall 157. The first inner lifter surface 150 also includes a plurality of angled walls referred to herein as a first angled wall 169-*a*, a second angled wall 169-*b*, a third angled wall 169-*c*, and a fourth angled wall 169-*d*. Referring to FIG. 13, the first wall 151 is adjacent to a surface 152 that is circular in shape and oriented to be orthogonal to the valve lifter axis 111 of the valve lifter body 110. In FIG. 13, the first wall 151 is adjacent to a first angled lifter surface 165, and a second angled lifter surface 166. The first angled wall 169-*a* is shown extending axially into the valve lifter body 110 from the first lifter opening 132 and terminating at the first angled surface 165. The first angled lifter surface 165 is adjacent to a surface 152 and a first curved lifter surface 154. As depicted in FIG. 14 the first angled lifter surface 165 is configured to be at an angle 100 relative to a plane that is orthogonal to the valve lifter axis 111 of the valve lifter body 110 (such as the plane of the annular surface 44 of the adjusting body 10). Advantageously, the angle 100 measures between twenty-five and about ninety degrees.

The second angled lifter surface 166 is adjacent to the lifter surface 152. The fourth angled wall 169-*d* is shown extending axially into the valve lifter body 110 from the first lifter opening 132 and terminating at the second angled surface 166. As shown in FIG. 14, the second angled lifter surface 166 is configured to be at an angle 100 relative to a plane that is orthogonal to the axis of the valve lifter body 110, preferably between twenty-five and about ninety degrees. The second angled lifter surface 166 is adjacent to a second curved lifter surface 155. The second curved lifter surface 155 is adjacent to a third angled lifter surface 167 and a third wall 156. The third angled lifter surface 167 is adjacent to the lifter surface 152 and a second wall 153. The second angled wall 169-*b* is shown extending axially into the valve lifter body 110 from the first lifter opening 132 and terminating at the third angled surface 167. As depicted in FIG. 14, the third angled lifter surface 167 is configured to be at an angle 100 relative to a plane that is orthogonal to the valve lifter axis 111 of the valve lifter body 110 (such as the plane of the annular surface 44 of the adjusting body 10). Advantageously the angle 100 measures between twenty-five and about ninety degrees.

The second wall 153 is adjacent to a fourth angled lifter surface 168. The fourth angled lifter surface 168 adjacent to the first curved lifter surface 154 and a fourth wall 157. The third angled wall 169-*c* is shown extending axially into the valve lifter body 110 from the first lifter opening 132 and terminating at the fourth angled surface 168. As depicted in FIG. 14, the fourth angled lifter surface 168 is configured to be at an angle 100 relative to a plane that is orthogonal to the valve lifter axis 111 of the valve lifter body 110 (such as the plane of the annular surface 44 of the adjusting body 10). Advantageously, the angle 100 measures between twenty-five and about ninety degrees. FIG. 14 depicts a cross-sectional view of an embodiment with the first lifter cavity 130 of FIG. 13.

Figure 15:
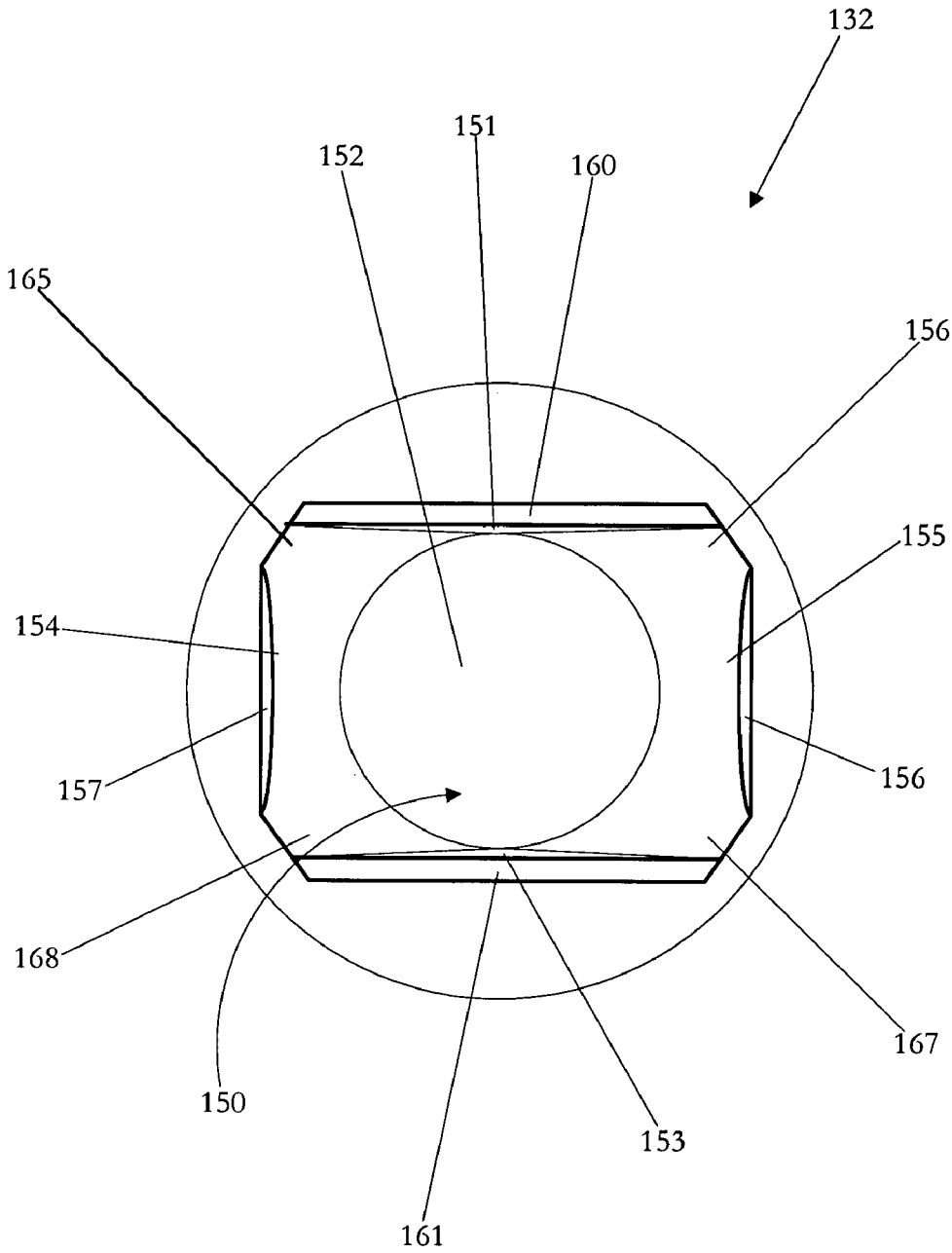
FIG. 15 depicts the top view of another preferred embodiment of a valve lifter body.

Shown in FIG. 15 is an alternative embodiment of the first lifter cavity 130 depicted in FIG. 13. In the embodiment depicted in FIG. 15, the first lifter cavity 130 is provided with a chamfered lifter opening 132 and a first inner lifter surface 150. The chamfered lifter opening 132 functions so that a cylindrical insert can be introduced to the valve lifter body 110 with greater ease. The chamfered lifter opening 132 accomplishes this function through lifter chamfers 160, 161 which are located on opposing sides of the chamfered lifter opening 132. The lifter chamfers 160, 161 of the embodiment shown in FIG. 15 are flat surfaces at an angle relative to the flat lifter surfaces 141, 142 so that a cylindrical insert 190 can be introduced through the first lifter opening 132 with greater ease. Those skilled in the art will appreciate that the lifter chamfers 160, 161 can be fabricated in a number of different configurations; so long as the resulting configuration renders introduction of a cylindrical insert 190 through the first lifter opening 132 with greater ease, it is a "chamfered lifter opening" within the spirit and scope of the present invention.

The lifter chamfers 160, 161 are preferably fabricated through forging via an extruding punch pin. Alternatively, the lifter chamfers 160, 161 are machined by being ground before heat-treating. Those skilled in the art will appreciate that other methods of fabrication can be employed within the scope of the present invention.

Figure 16:
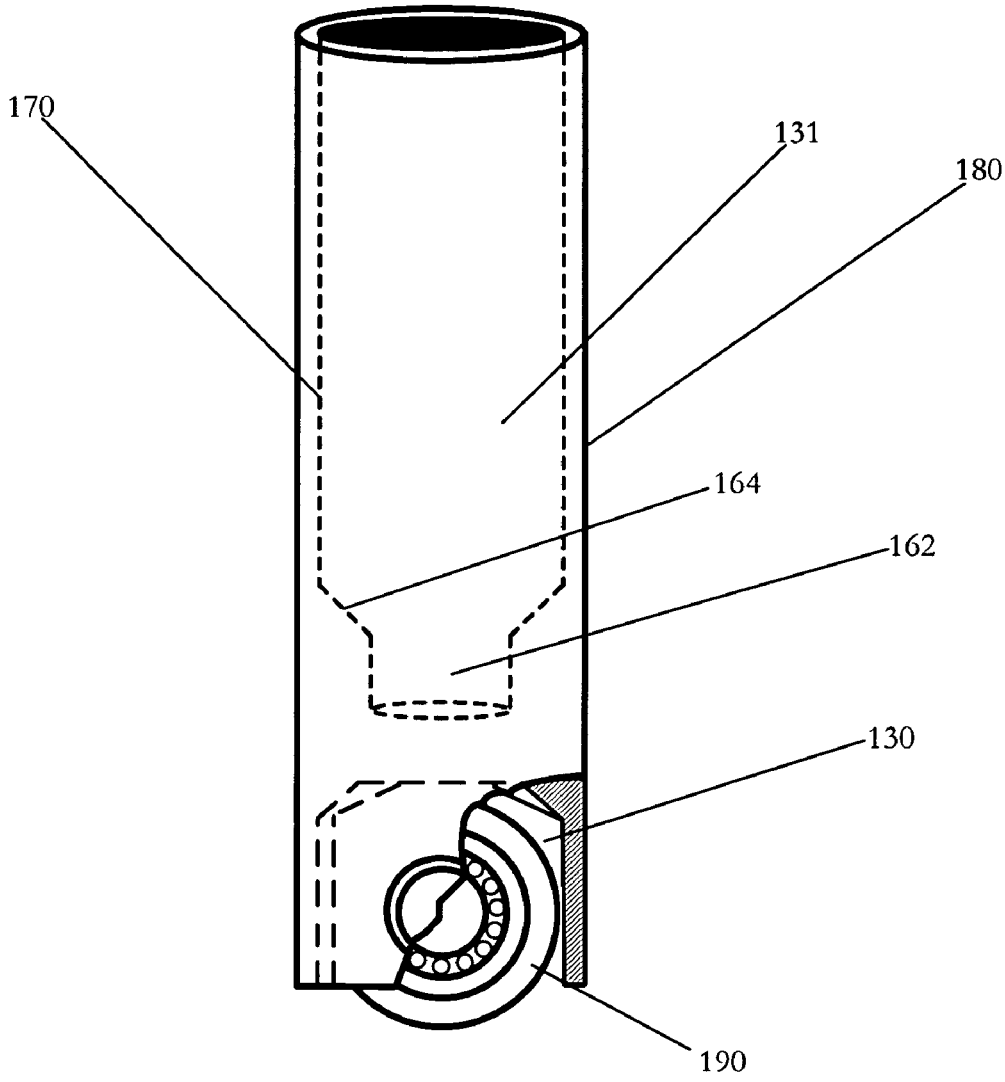
FIG. 16 depicts a fourth embodiment of a valve lifter body.

FIG. 16 discloses yet another alternative embodiment of the present invention. As depicted in FIG. 16, the valve lifter body 110 is provided with a second lifter cavity 131 which includes a plurality of cylindrical and conical surfaces. The second lifter cavity 131 depicted in FIG. 16 includes a second inner lifter surface 170. The second inner lifter surface 170 of the preferred embodiment is cylindrically shaped, concentric relative to the cylindrically shaped outer surface 180. The second inner lifter surface 170 is provided with a lifter well 162. The lifter well 162 is shaped to accommodate a spring (not shown). In the embodiment depicted in FIG. 16, the lifter well 162 is cylindrically shaped at a diameter that is smaller than the diameter of the second inner lifter surface 170. The cylindrical shape of the lifter well 162 is preferably concentric relative to the outer lifter surface 180. The lifter well 162 is preferably forged through use of an extruding die pin.

Alternatively, the lifter well 162 is machined by boring the lifter well 162 in a chucking machine. Alternatively, the lifter well 162 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 162 is ground using an internal diameter grinding machine, such as a Heald grinding machine. Those skilled in the art will appreciate that the lifter well 162 can be ground using other grinding machines.

Adjacent to the lifter well 162, the embodiment depicted in FIG. 16 is provided with a conically-shaped lead lifter surface 164 which can be fabricated through forging or machining. However, those skilled in the art will appreciate that the present invention can be fabricated without the lead lifter surface 164.

Figure 17:
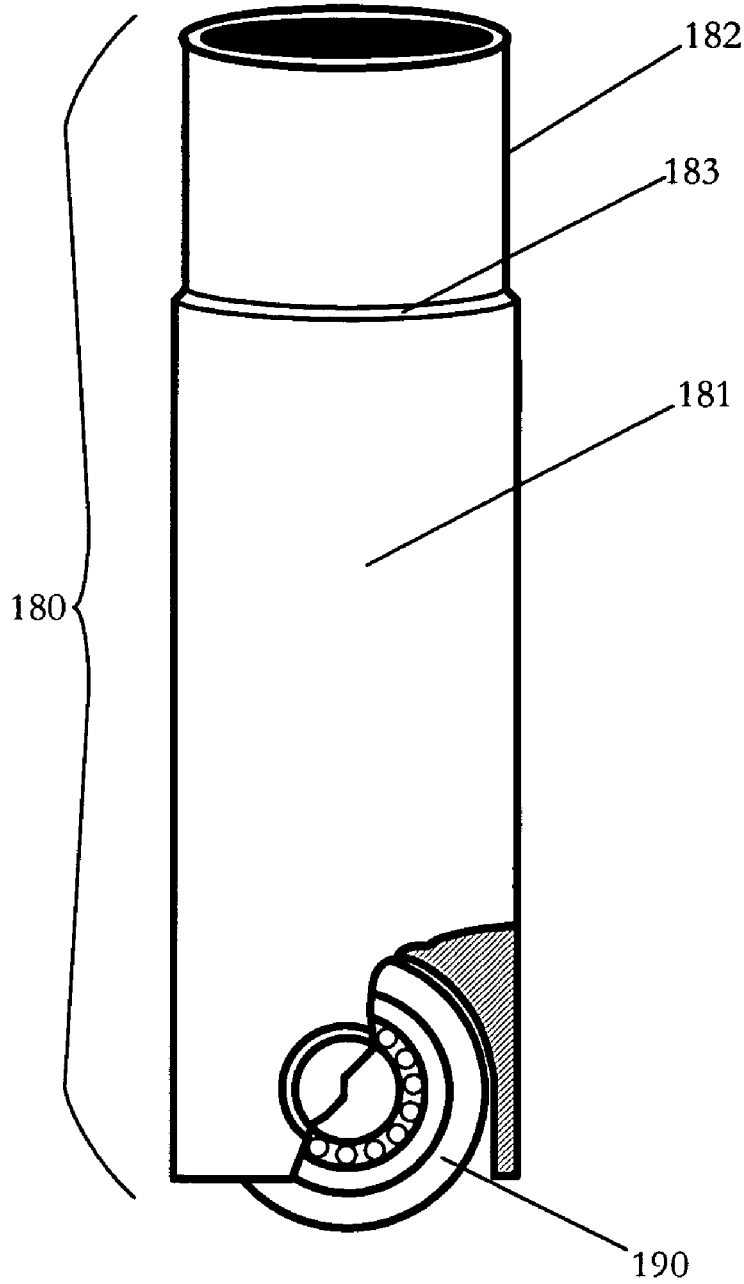
FIG. 17 depicts a fourth embodiment of a valve lifter body.

Depicted in FIG. 17 is another alternative embodiment of the present invention. As shown in FIG. 17, the valve lifter body 110 is provided with an outer lifter surface 180. The outer lifter surface 180 includes a plurality of surfaces. In the embodiment depicted in FIG. 17, the outer lifter surface 180 includes a cylindrical lifter surface 181, an undercut lifter surface 182, and a conical lifter surface 183. As depicted in FIG. 17, the undercut lifter surface 182 extends from one end of the valve lifter body 110 and is cylindrically shaped. The diameter of the undercut lifter surface 182 is smaller than the diameter of the cylindrical lifter surface 181.

The undercut lifter surface 182 is preferably forged through use of an extruding die. Alternatively, the undercut lifter surface 182 is fabricated through machining. Machining the undercut lifter surface 182 is accomplished through use of an infeed centerless grinding machine, such as a Cincinnati grinder. The surface is first heat-treated and then the undercut lifter surface 182 is ground via a grinding wheel. Those skilled in the art will appreciate that additional surfaces can be ground into the outer lifter surface 180 with minor alterations to the grinding wheel.

As depicted in FIG. 17, the conical lifter surface 183 is located between the cylindrical lifter surface 181 and the undercut lifter surface 182. The conical lifter surface 183 is preferably forged through use of an extruding die. Alternatively, the conical lifter surface 183 is fabricated through machining. Those with skill in the art will appreciate that the outer lifter surface 180 can be fabricated without the conical lifter surface 183 so that the cylindrical lifter surface 181 and the undercut lifter surface 182 abut one another.

Figure 18:
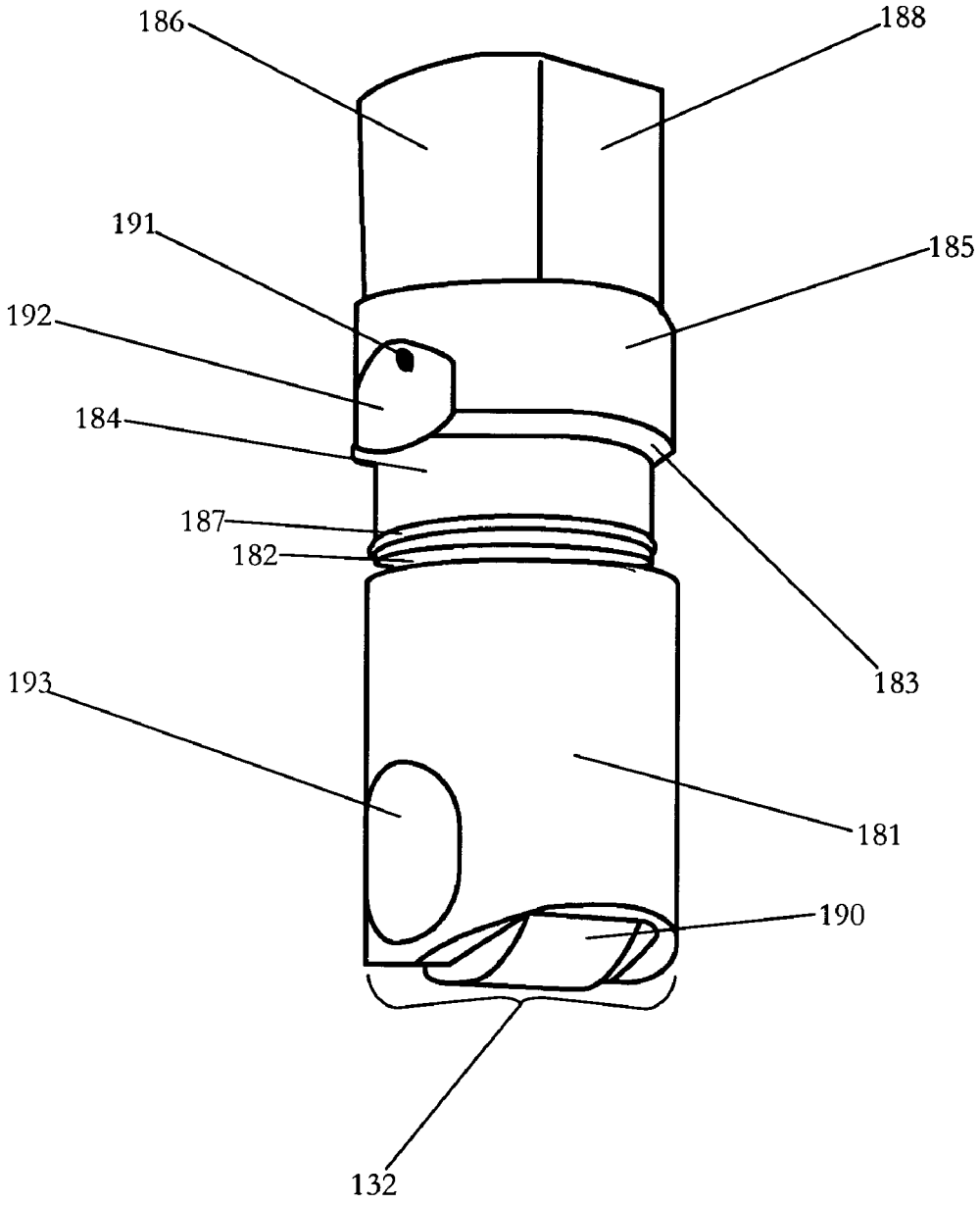
FIG. 18 depicts a fifth embodiment of a valve lifter body.

FIG. 18 depicts another embodiment valve lifter body 110 of the present invention. In the embodiment depicted in FIG. 18, the outer lifter surface 180 includes a plurality of outer surfaces. The outer lifter surface 180 is provided with a first cylindrical lifter surface 181. The first cylindrical lifter surface 181 contains a first lifter depression 193. Adjacent to the first cylindrical lifter surface 181 is a second cylindrical lifter surface 182. The second cylindrical lifter surface 182 has a radius which is smaller than the radius of the first cylindrical lifter surface 181. The second cylindrical lifter surface 182 is adjacent to a third cylindrical lifter surface 184. The third cylindrical lifter surface 184 has a radius which is greater than the radius of the second cylindrical lifter surface 182. The third cylindrical lifter surface 184 contains a lifter ridge 187. Adjacent to the third cylindrical lifter surface 184 is a conical lifter surface 183. The conical lifter surface 183 is adjacent to a fourth cylindrical lifter surface 185. The fourth cylindrical lifter surface 185 and the conical lifter surface 183 contain a second lifter depression 192. The second lifter depression 192 defines a lifter hole 191. Adjacent to the fourth cylindrical lifter surface 185 is a flat outer lifter surface 188. The flat outer lifter surface 188 is adjacent to a fifth cylindrical lifter surface 186.

Those skilled in the art will appreciate that the features of the valve lifter body 110 may be fabricated through a combination of machining, forging, and other methods of fabrication. By way of example and not limitation, the first lifter cavity 130 can be machined while the second lifter cavity 131 is forged. Conversely, the second lifter cavity 131 can be machined while the first lifter cavity 130 is forged.

Figure 20:
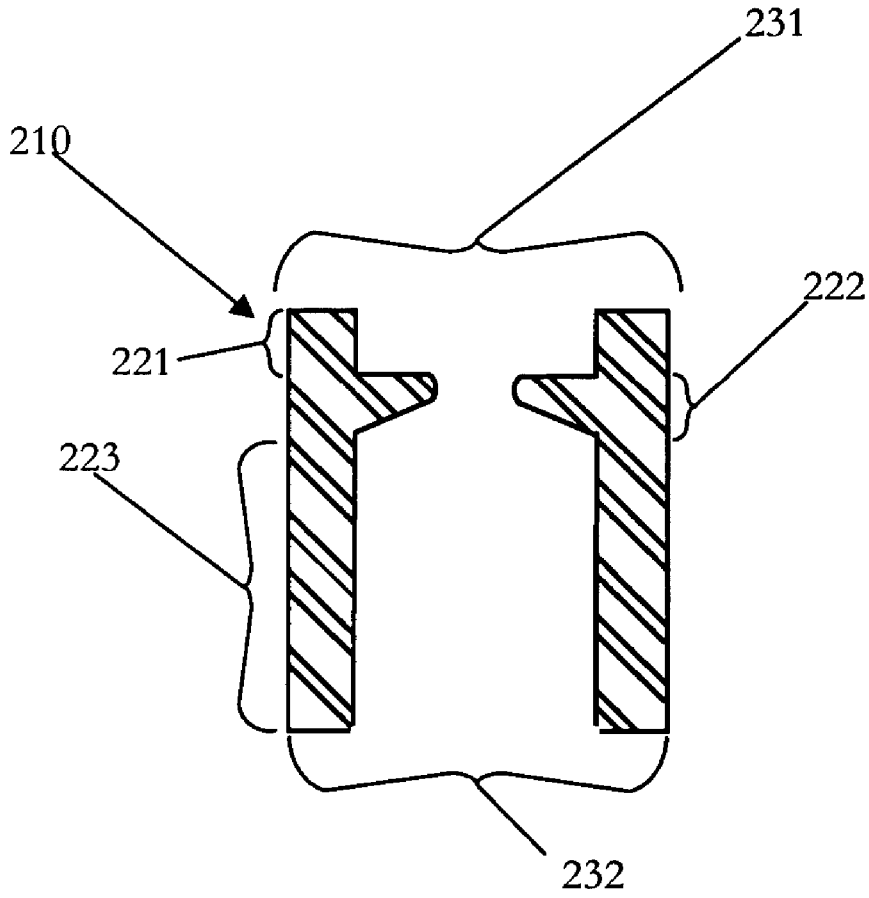
FIG. 20 depicts a preferred embodiment of a leakdown plunger.
Figure 21:
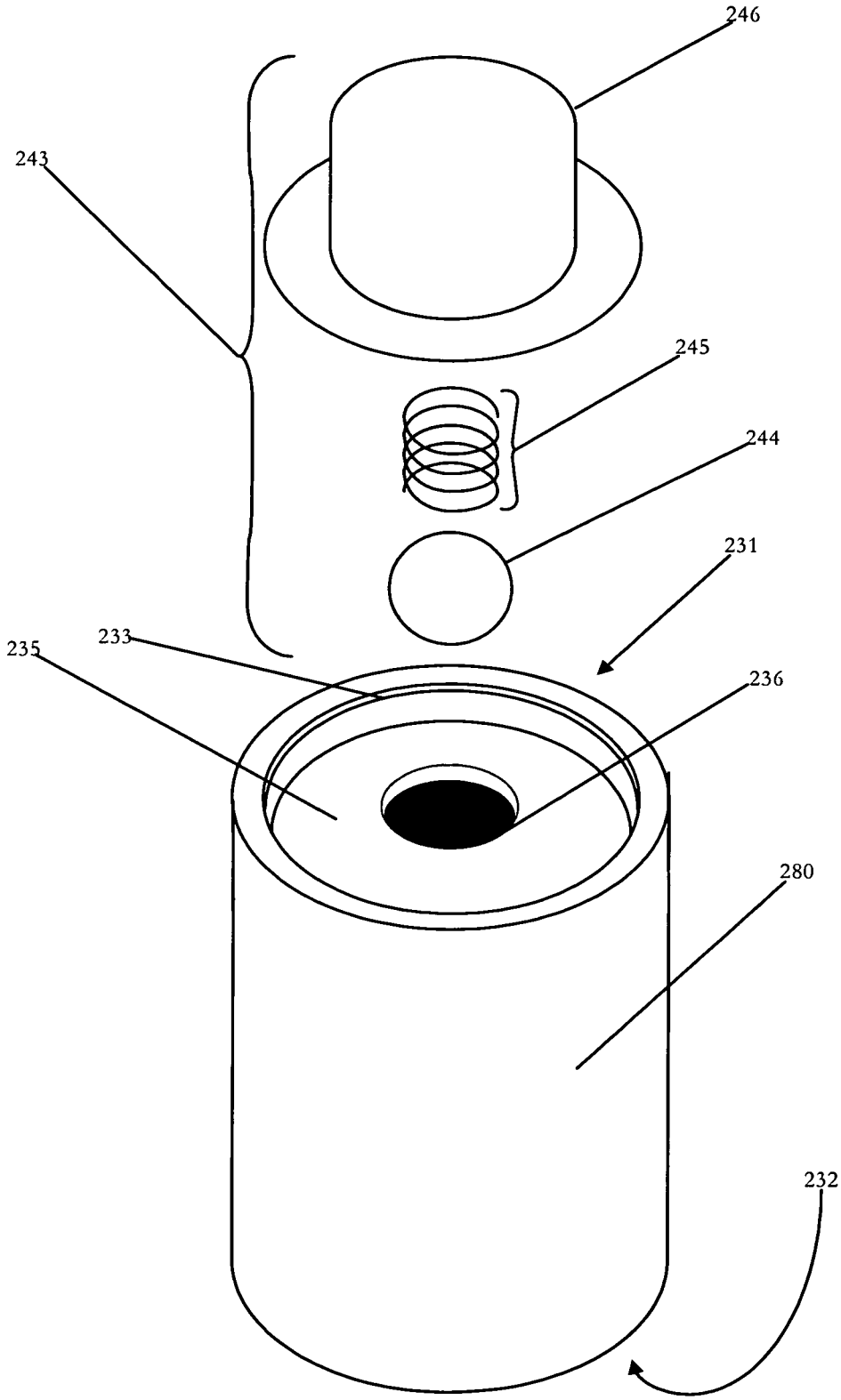
FIG. 21 depicts a preferred embodiment of a leakdown plunger.
Figure 22:
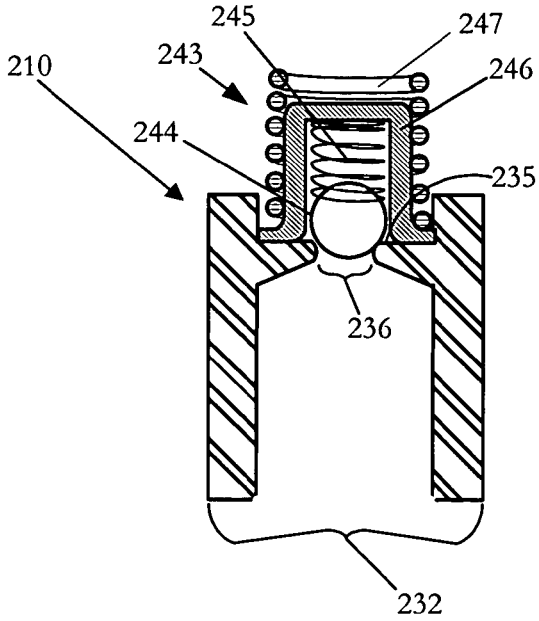
FIG. 22 depicts a cross-sectional view of a preferred embodiment of a leakdown plunger.

Turning now to FIG. 7, a plurality of inserts are shown within the adjusting body 10. As depicted therein, a leakdown plunger 210 is preferably located within the adjusting body 10. FIGS. 20, 21, and 22 show a leakdown plunger 210 of the preferred embodiment. The leakdown plunger 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 210 is composed of pearlitic material. According to still another aspect of the present invention, the leakdown plunger 210 is composed of austenitic material. According to another aspect of the present invention, the metal is a ferritic material.

The leakdown plunger 210 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 20 depicts a cross-sectional view of the leakdown plunger 210 composed of a plurality of plunger elements. FIG. 20 shows the leakdown plunger, generally designated 210. The leakdown plunger 210 functions to accept a liquid, such as a lubricant and is provided with a first plunger opening 231 and a second plunger opening 232. The first plunger opening 231 functions to accommodate an insert.

The leakdown plunger 210 of the preferred embodiment is fabricated from a single piece of metal wire or rod and is described herein as a plurality of plunger elements. The leakdown plunger 210 includes a first hollow plunger element 221, a second hollow plunger element 223, and an insert-accommodating plunger element 222. As depicted in FIG. 20, the first hollow plunger element 221 is located adjacent to the insert-accommodating plunger element 222. The insert-accommodating plunger element 222 is located adjacent to the second hollow plunger element 223.

The leakdown plunger 210 is provided with a plurality of outer surfaces and inner surfaces. FIG. 21 depicts the first plunger opening 231 of an alternative embodiment. The first plunger opening 231 of the embodiment depicted in FIG. 21 is advantageously provided with a chamfered plunger surface 233, however a chamfered plunger surface 233 is not necessary. When used herein in relation to a surface, the term "chamfered" shall mean a surface that is rounded or angled.

The first plunger opening 231 depicted in FIG. 21 is configured to accommodate an insert. The first plunger opening 231 is shown in FIG. 21 accommodating a valve insert 243. In the embodiment depicted in FIG. 21, the valve insert 243 is shown in an exploded view and includes a generally spherically shaped valve insert member 244, an insert spring 245, and a cap 246. Those skilled in the art will appreciate that valves other than the valve insert 243 shown herein can be used without departing from the scope and spirit of the present invention.

As shown in FIG. 21, the first plunger opening 231 is provided with an annular plunger surface 235 defining a plunger hole 236. The plunger hole 236 is shaped to accommodate an insert. In the embodiment depicted in FIG. 21, the plunger hole 236 is shaped to accommodate the spherical valve insert member 244. The spherical valve insert member 244 is configured to operate with the insert spring 245 and the cap 246. The cap 246 is shaped to at least partially cover the spherical valve insert member 244 and the insert spring 245. The cap 246 is preferably fabricated through stamping. However, the cap 246 may be forged or machined without departing from the scope or spirit of the present invention.

FIG. 22 shows a cross-sectional view of the leakdown plunger 210 depicted in FIG. 21 in a semi-assembled state. In FIG. 22 the valve insert 243 is shown in a semi-assembled state. As depicted in FIG. 22, a cross-sectional view of a cap spring 247 is shown around the cap 246. Those skilled in the art will appreciate that the cap spring 247 and the cap 246 are configured to be inserted into the well of another body. According to one aspect of the present invention, the cap spring 247 and the cap 246 are configured to be inserted into the well of a lash adjuster body. In the preferred embodiment, the cap spring 247 and cap 246 are configured to be inserted into the lash adjuster well 50 of the lash adjuster 10.

The cap 246 is configured to at least partially depress the insert spring 245. The insert spring 245 exerts a force on the spherical valve insert member 244. In FIG. 22, the annular plunger surface 235 is shown with the spherical valve insert member 244 partially located within the plunger hole 236.

Figure 30:
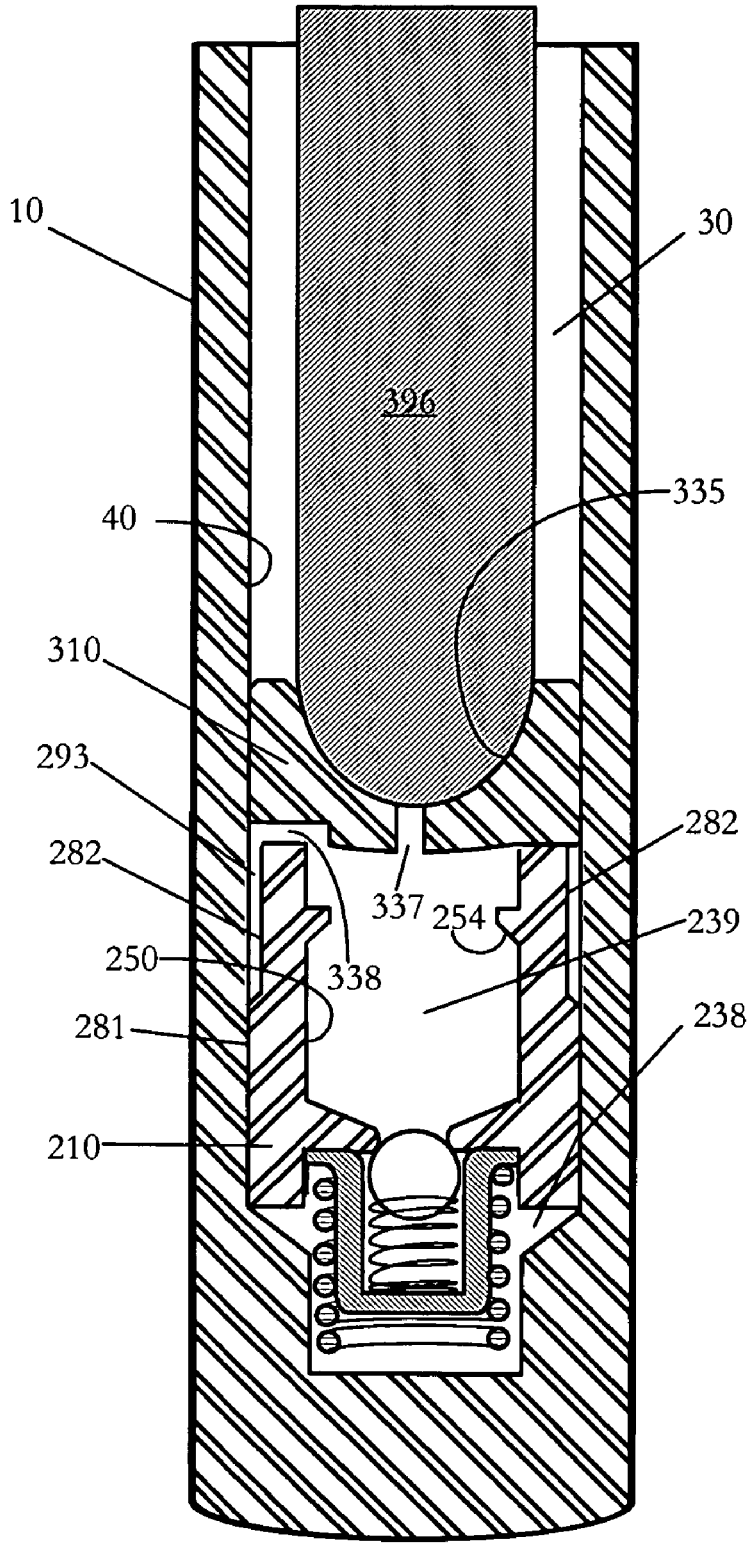
FIG. 30 depicts a sixth embodiment of a leakdown plunger.

Referring now to FIG. 21, the leakdown plunger 210 is provided with an outer plunger surface 280. The outer plunger surface 280 is preferably shaped so that the body can be inserted into a lash adjuster body. In the preferred embodiment, the outer plunger surface 280 is shaped so that the leakdown plunger 210 can be inserted into the adjusting body 10. Depicted in FIG. 30 is an adjusting body 10 having an inner surface 40 defining a cavity 30. An embodiment of the leakdown plunger 210 is depicted in FIG. 30 within the cavity 30 of the adjusting body 10. As shown in FIG. 30, the leakdown plunger 210 is preferably provided with an outer plunger surface 280 that is cylindrically shaped.

Figure 23:
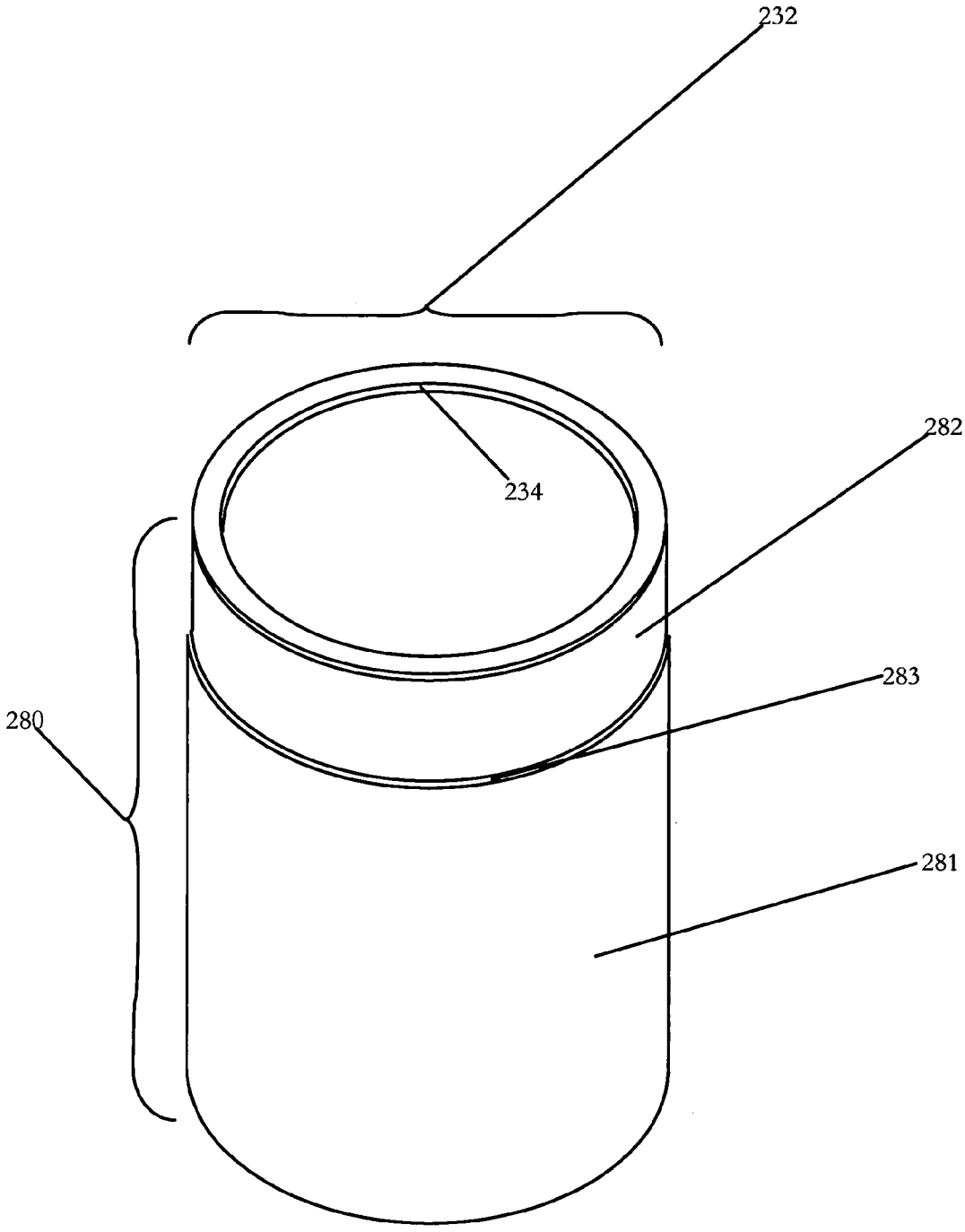
FIG. 23 depicts a perspective view of another preferred embodiment of a leakdown plunger.

FIG. 23 depicts a leakdown plunger 210 of an alternative embodiment. FIG. 23 depicts the second plunger opening 232 in greater detail. The second plunger opening 232 is shown with a chamfered plunger surface 234. However, those with skill in the art will appreciate that the second plunger opening 232 may be fabricated without the chamfered plunger surface 234.

In FIG. 23 the leakdown plunger 210 is provided with a plurality of outer surfaces. As shown therein, the embodiment is provided with an outer plunger surface 280. The outer plunger surface 280 includes a plurality of surfaces. FIG. 23 depicts a cylindrical plunger surface 281, an undercut plunger surface 282, and a conical plunger surface 283. As depicted in FIG. 23, the undercut plunger surface 282 extends from one end of the leakdown plunger 210 and is cylindrically shaped. The diameter of the undercut plunger surface 282 is smaller than the diameter of the cylindrical plunger surface 281.

The undercut plunger surface 282 is preferably forged through use of an extruding die. Alternatively, the undercut plunger surface 282 is fabricated through machining. Machining the undercut plunger surface 282 is accomplished through use of an infeed centerless grinding machine, such as a Cincinnati grinder. The surface is first heat-treated and then the undercut plunger surface 282 is ground via a grinding wheel. Those skilled in the art will appreciate that additional surfaces can be ground into the outer plunger surface 280 with minor alterations to the grinding wheel.

Referring again to FIG. 23, the conical plunger surface 283 is located between the cylindrical plunger surface 281 and the undercut plunger surface 282. Those with skill in the art will appreciate that the outer plunger surface 280 can be fabricated without the conical plunger surface 283 so that the cylindrical plunger surface 281 and the undercut plunger surface 282 abut one another.

Figure 25:
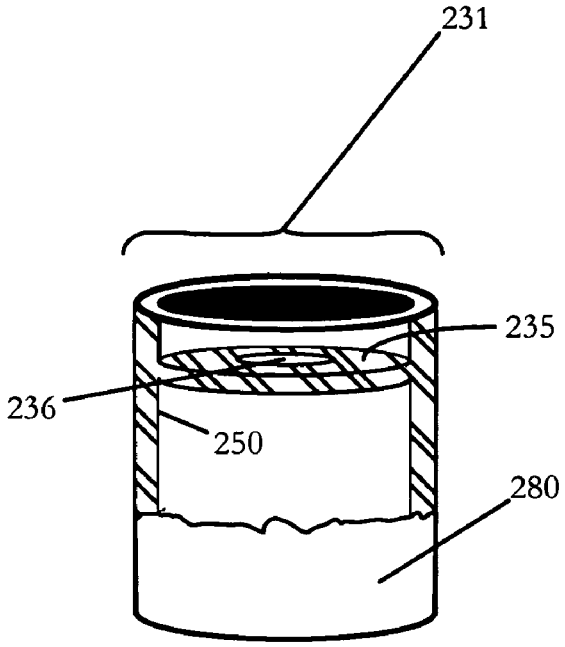
FIG. 25 depicts a third embodiment of a leakdown plunger.

FIG. 25 depicts an embodiment of the leakdown plunger 210 with a section of the outer plunger surface 280 broken away. The embodiment depicted in FIG. 25 is provided with a first plunger opening 231. As shown in FIG. 25, the outer plunger surface 280 encloses an inner plunger surface 250. The inner plunger surface 250 includes an annular plunger surface 235 that defines a plunger hole 236.

Figure 26:
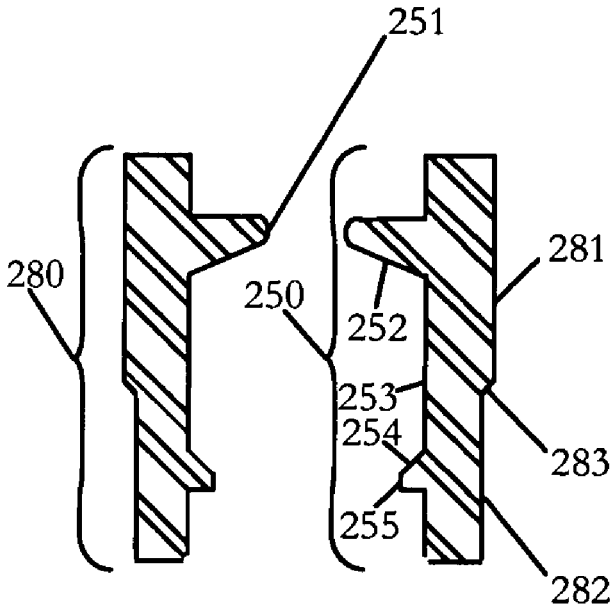
FIG. 26 depicts a fourth embodiment of a leakdown plunger.

FIG. 26 depicts a cross-sectional view of a leakdown plunger of an alternative embodiment. The leakdown plunger 210 shown in FIG. 26 is provided with an outer plunger surface 280 that includes a plurality of cylindrical and conical surfaces. In the embodiment depicted in FIG. 26, the outer plunger surface 280 includes an outer cylindrical plunger surface 281, an undercut plunger surface 282, and an outer conical plunger surface 283. As depicted in FIG. 26, the undercut plunger surface 282 extends from one end of the leakdown plunger 210 and is cylindrically shaped. The diameter of the undercut plunger surface 282 is smaller than, and preferably concentric relative to, the diameter of the outer cylindrical plunger surface 281. The outer conical plunger surface 283 is located between the outer cylindrical plunger surface 281 and the undercut plunger surface 282. Those with skill in the art will appreciate that the outer plunger surface 280 can be fabricated without the conical plunger surface 283 so that the outer cylindrical plunger surface 281 and the undercut plunger surface 282 abut one another.

Figure 27:
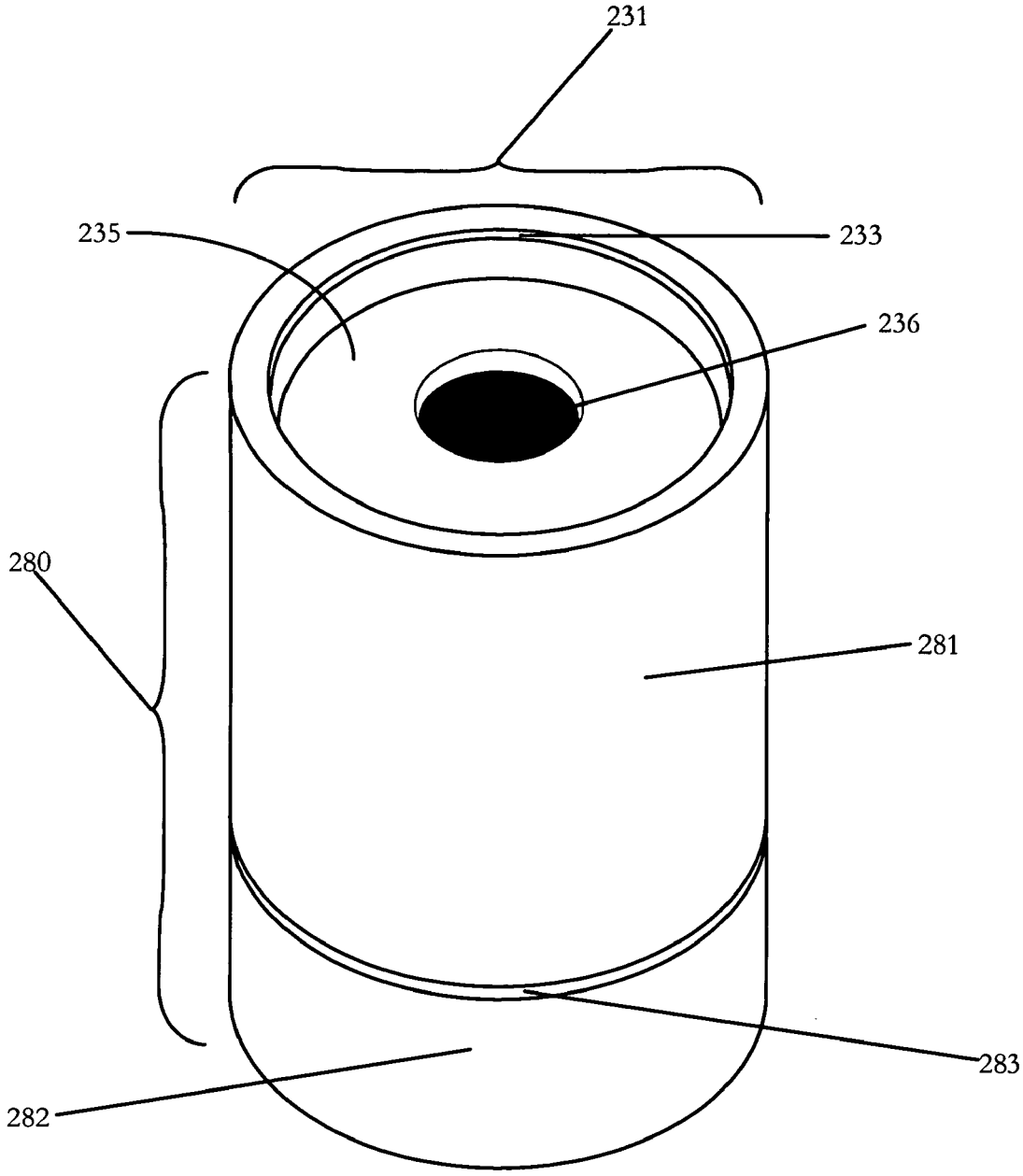
FIG. 27 depicts a fifth embodiment of a leakdown plunger.

FIG. 27 depicts in greater detail the first plunger opening 231 of the embodiment depicted in FIG. 26. The first plunger opening 231 is configured to accommodate an insert and is preferably provided with a first chamfered plunger surface 233. Those skilled in the art, however, will appreciate that the first chamfered plunger surface 233 is not necessary. As further shown in FIG. 27, the first plunger opening 231 is provided with a first annular plunger surface 235 defining a plunger hole 236.

The embodiment depicted in FIG. 27 is provided with an outer plunger surface 280 that includes a plurality of surfaces. The outer plunger surface 280 includes a cylindrical plunger surface 281, an undercut plunger surface 282, and a conical plunger surface 283. As depicted in FIG. 27, the undercut plunger surface 282 extends from one end of the leakdown plunger 210 and is cylindrically shaped. The diameter of the undercut plunger surface 282 is smaller than the diameter of the cylindrical plunger surface 281. The conical plunger surface 283 is located between the cylindrical plunger surface 281 and the undercut plunger surface 282. However, those with skill in the art will appreciate that the outer plunger surface 280 can be fabricated without the conical plunger surface 283 so that the cylindrical plunger surface 281 and the undercut plunger surface 282 abut one another. Alternatively, the cylindrical plunger surface 281 may abut the undercut plunger surface 282 so that the conical plunger surface 283 is an annular surface.

Figure 28:
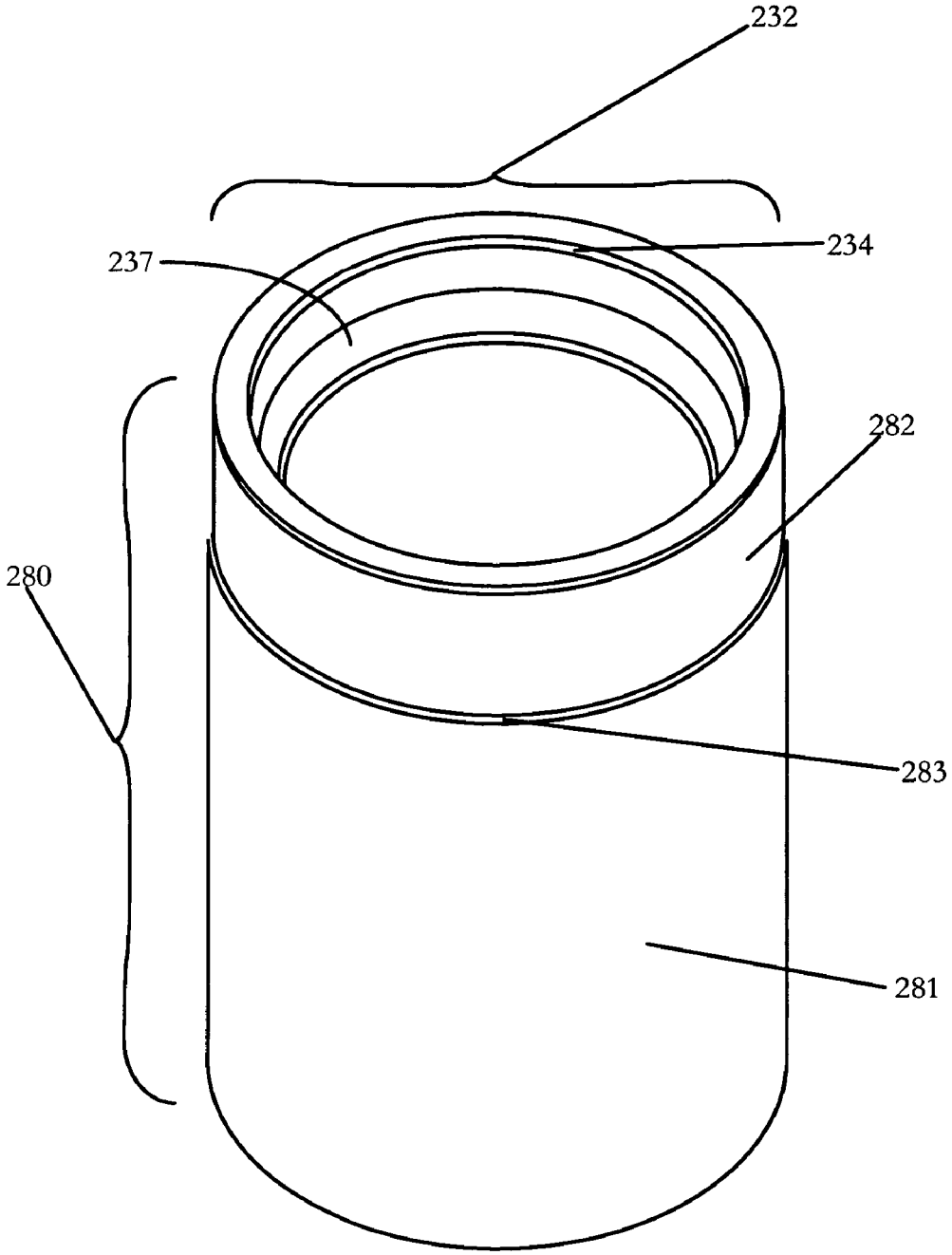
FIG. 28 depicts a perspective view of another preferred embodiment of a leakdown plunger.

FIG. 28 depicts the second plunger opening 232 of the embodiment depicted in FIG. 26. The second plunger opening 232 is shown with a second chamfered plunger surface 234. However, those with skill in the art will appreciate that the second plunger opening 232 may be fabricated without the second chamfered plunger surface 234. The second plunger opening 232 is provided with a second annular plunger surface 237.

Figure 29:
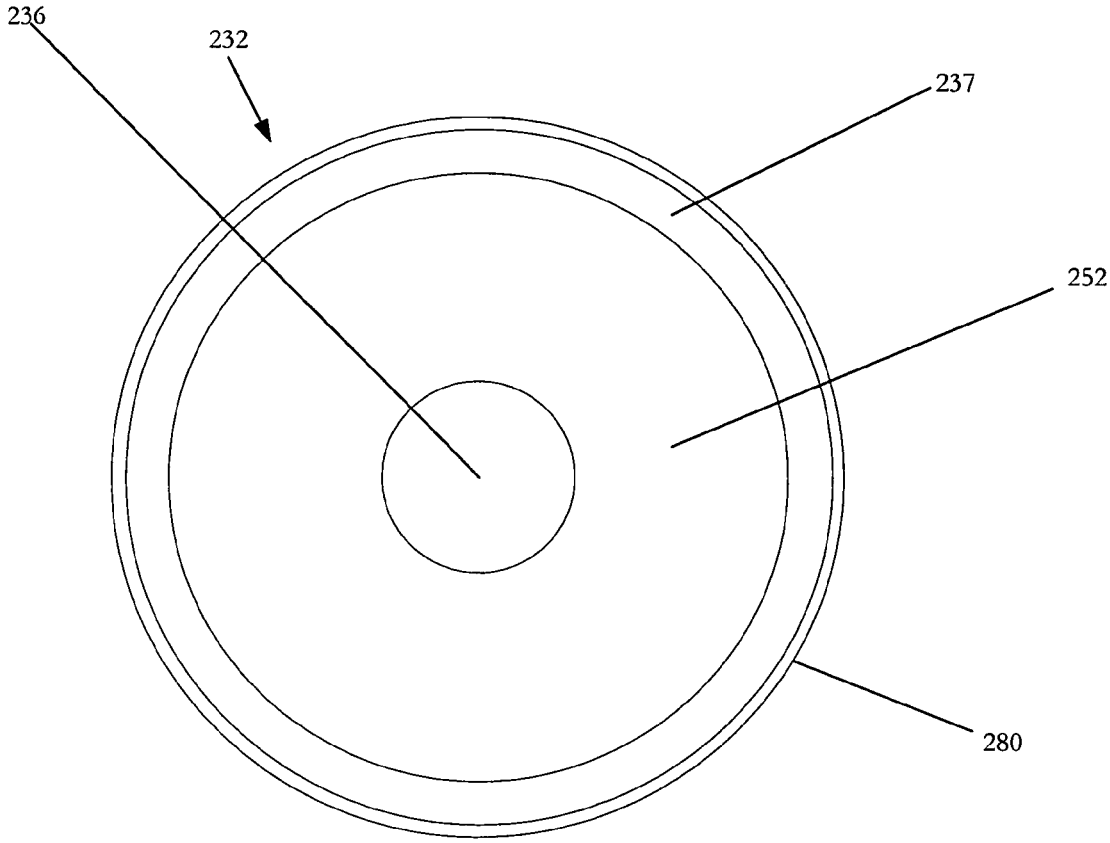
FIG. 29 depicts the top view of another preferred embodiment of a leakdown plunger.

FIG. 29 depicts a top view of the second plunger opening 232 of the embodiment depicted in FIG. 26. In FIG. 29, the second annular plunger surface 237 is shown in relation to the first inner conical plunger surface 252 and the plunger hole 236. As shown in FIG. 29, the plunger hole 236 is concentric relative to the outer plunger surface 280 and the annulus formed by the second annular plunger surface 237.

Figure 24:
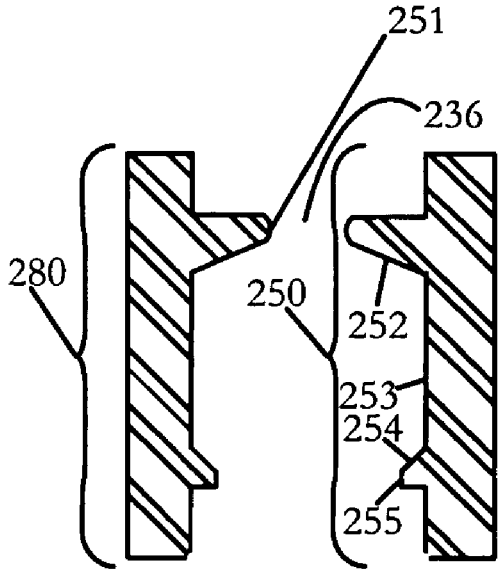
FIG. 24 depicts a second embodiment of a leakdown plunger.

Referring now to FIG. 24, the outer plunger surface 280 encloses an inner plunger surface 250. The inner plunger surface 250 includes a plurality of surfaces. In the alternative embodiment depicted in FIG. 24, the inner plunger surface 250 includes a rounded plunger surface 251 that defines a plunger hole 236. Those skilled in the art will appreciate that the rounded plunger surface 251 need not be rounded, but may be flat. The inner plunger surface 250 includes a first inner conical plunger surface 252 and a second inner conical plunger surface 254, a first inner cylindrical plunger surface 253, and a second inner cylindrical plunger surface 255. The first inner conical plunger surface 252 is located adjacent to the rounded plunger surface 251. Adjacent to the first inner conical plunger surface 252 is the first inner cylindrical plunger surface 253. The first inner cylindrical plunger surface 253 is adjacent to the second inner conical plunger surface 254. The second inner conical plunger surface 254 is adjacent to the second inner cylindrical plunger surface 255.

FIG. 30 depicts an embodiment of the leakdown plunger 210 within another body cooperating with a plurality of inserts. The undercut plunger surface 282 preferably cooperates with another body, such as a lash adjuster body, to form a leakdown path 293. FIG. 30 depicts an embodiment of the leakdown plunger 210 within an adjusting body 10; however, those skilled in the art will appreciate that the present invention may be inserted within other bodies, such as roller followers or a roller lifter body, such as the valve lifter body 110.

As shown in FIG. 30, in the preferred embodiment, the undercut plunger surface 282 is configured to cooperate with the inner surface 40 of an adjusting body 10. The undercut plunger surface 282 and the inner surface 40 of the adjusting body 10 cooperate to define a leakdown path 293 for a liquid such as a lubricant.

The embodiment depicted in FIG. 30 is further provided with a cylindrical plunger surface 281. The cylindrical plunger surface 281 cooperates with the inner surface 40 of the adjusting body 10 to provide a first chamber 238. Those skilled in the art will appreciate that the first chamber 238 functions as a high pressure chamber for a liquid, such as a lubricant.

The second plunger opening 232 is configured to cooperate with a socket, such as that disclosed in Applicants' "Metering Socket," application Ser. No. 10/316,262, filed on Oct. 28, 2002. In the preferred embodiment, the second plunger opening 232 is configured to cooperate with the socket 310. The socket 310 is configured to cooperate with a push rod 396. As shown in FIG. 30, the socket 310 is provided with a push rod cooperating surface 335. The push rod cooperating surface 335 is configured to function with a push rod 396. Those skilled in the art will appreciate that the push rod 396 cooperates with the rocker arm (not shown) of an internal combustion engine (not shown).

The socket 310 cooperates with the leakdown plunger 210 to define at least in part a second chamber 239 within the inner plunger surface 250. Those skilled in the art will appreciate that the second chamber 239 may advantageously function as a reservoir for a lubricant. The inner plunger surface 250 of the leakdown plunger 210 functions to increase the quantity of retained fluid in the second chamber 239 through the damming action of the second inner conical plunger surface 254.

The socket 310 is provided with a plurality of passages that function to fluidly communicate with the cavity 30 of the adjusting body 10. In the embodiment depicted in FIG. 30, the socket 310 is provided with a socket passage 337 and a plunger reservoir passage 338. The plunger reservoir passage 338 functions to fluidly connect the second chamber 239 with the cavity 30 of the adjusting body 10. As shown in FIG. 30, the socket passage 337 functions to fluidly connect the socket 310 and the cavity 30 of the adjusting body 10.

FIGS. 31 to 35 illustrate the presently preferred method of fabricating a leakdown plunger. FIGS. 31 to 35 depict what is known in the art as "slug progressions" that show the fabrication of the leakdown plunger 210 of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 31:
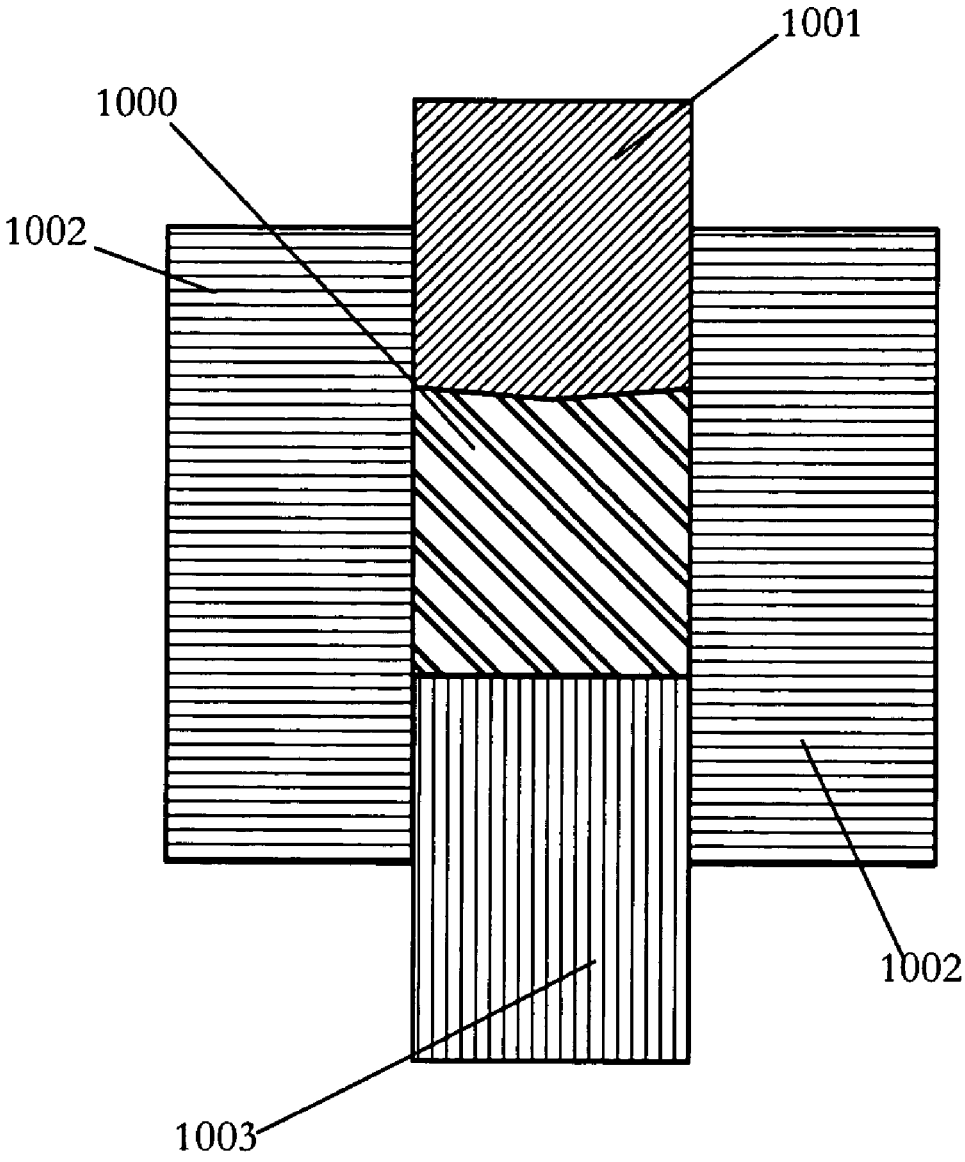
FIG. 31–35 depict a preferred method of fabricating a leakdown plunger.

The process of forging the leakdown plunger 210 an embodiment of the present invention begins with a metal wire or metal rod 1000 which is drawn to size. The ends of the wire or rod are squared off. As shown in FIG. 31, this is accomplished through the use of a first punch 1001, a first die 1002, and a first knock out pin 1003.

Figure 32:
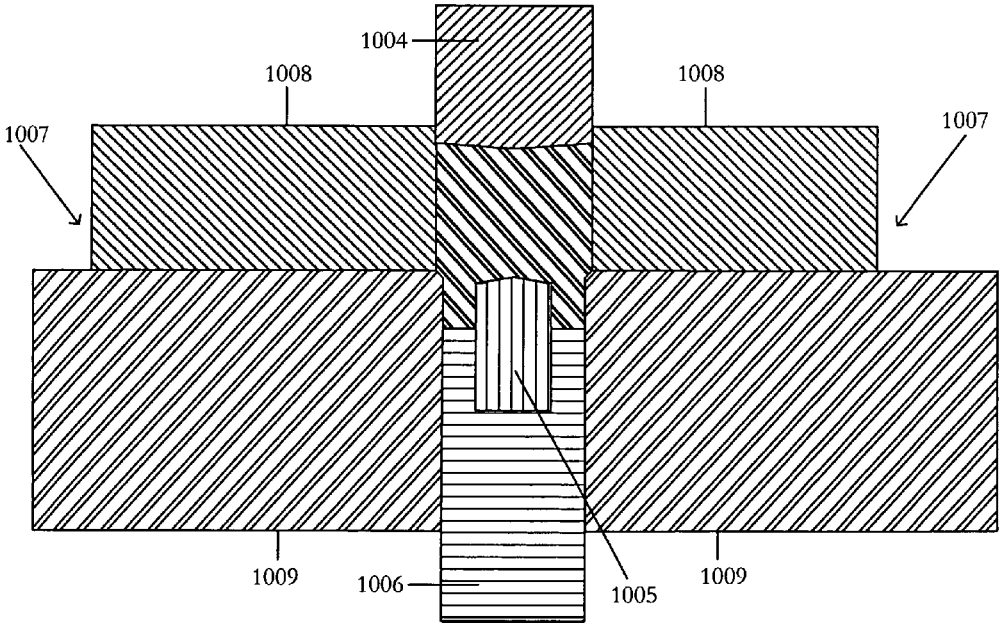

After being drawn to size, the wire or rod 1000 is run through a series of dies or extrusions. As depicted in FIG. 32, the fabrication of the second plunger opening 232 and the outer plunger surface 280 is preferably commenced through use of a second punch 1004, a second knock out pin 1005, a first sleeve 1006, and a second die 1007. The second plunger opening 232 is fabricated through use of the second knock out pin 1005 and the first sleeve 1006. The second die 1007 is used to fabricate the outer plunger surface 280. As shown in FIG. 32, the second die 1007 is composed of a second die top 1008 and a second die rear 1009. In the preferred forging process, the second die rear 1009 is used to form the undercut plunger surface 282 and the conical plunger surface 283.

Figure 33:
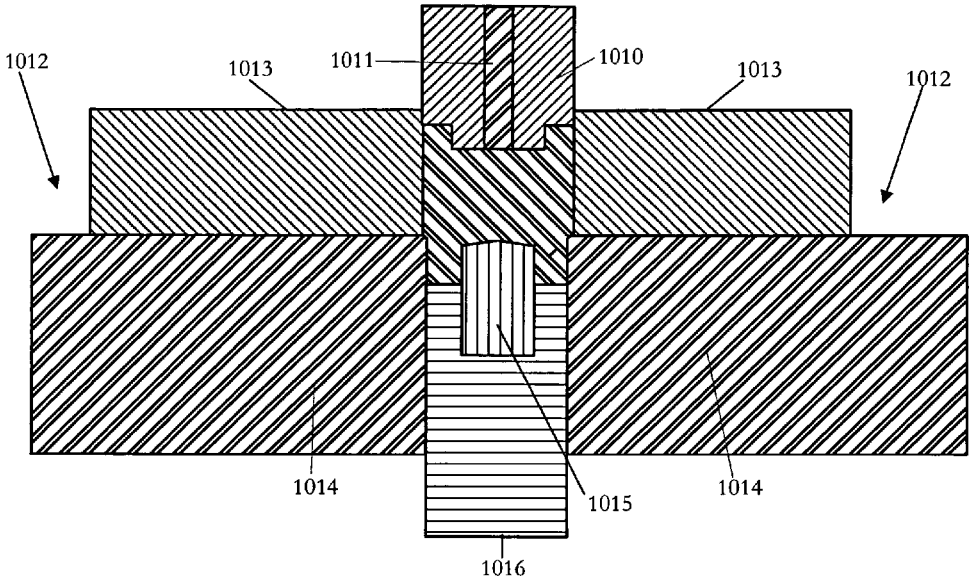

As depicted in FIG. 33, the first plunger opening 231 is fabricated through use of a third punch 1010. Within the third punch 1010 is a first pin 1011. The third punch 1010 and the first pin 1011 are used to fabricate at least a portion of the annular plunger surface 235. As shown in FIG. 33, it is desirable to preserve the integrity of the outer plunger surface 280 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second opening.

Figure 34:
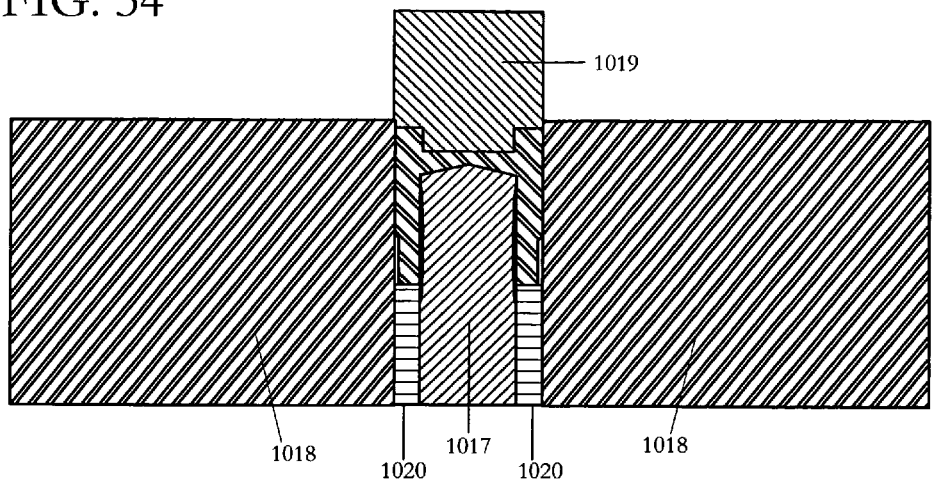

FIG. 34 depicts the forging of the inner plunger surface 250. As depicted, the inner plunger surface 250 is forged through use of a punch extrusion pin 1017. Those skilled in the art will appreciate that it is advantageous to preserve the integrity of the first plunger opening 231 and the outer plunger surface 280. This function is accomplished through use of a fourth die 1018 and a fourth knock out pin 1019. A punch stripper sleeve 1020 is used to remove the punch extrusion pin 1017 from the inner plunger surface 250.

Figure 35:
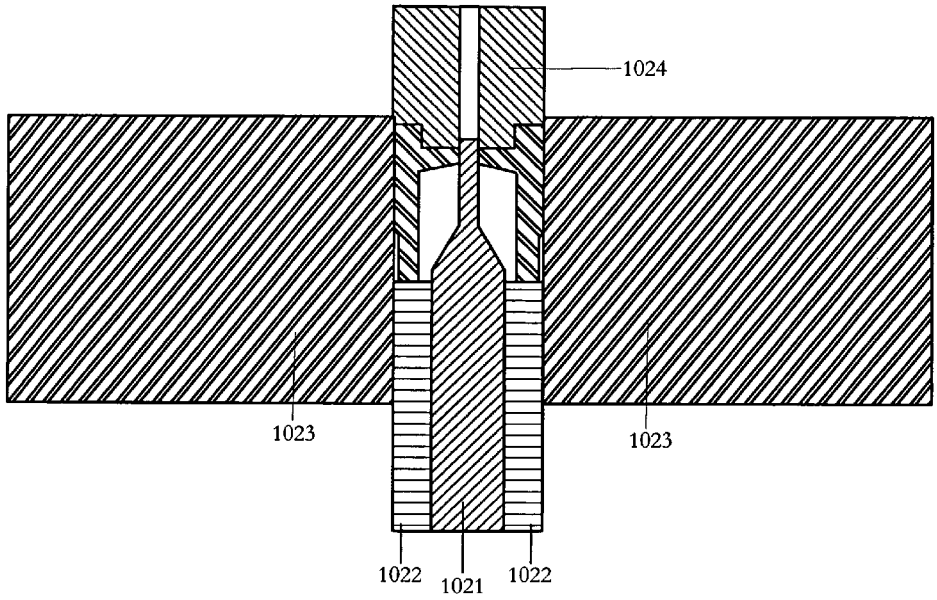

As shown in FIG. 35, the plunger hole 236 is fabricated through use of a piercing punch 1021 and a stripper sleeve 1022. To assure that other forging operations are not affected during the fabrication of the plunger hole 236, a fifth die 1023 is used around the outer plunger surface 280 and a tool insert 1024 is used at the first plunger opening 231.

Figure 36:
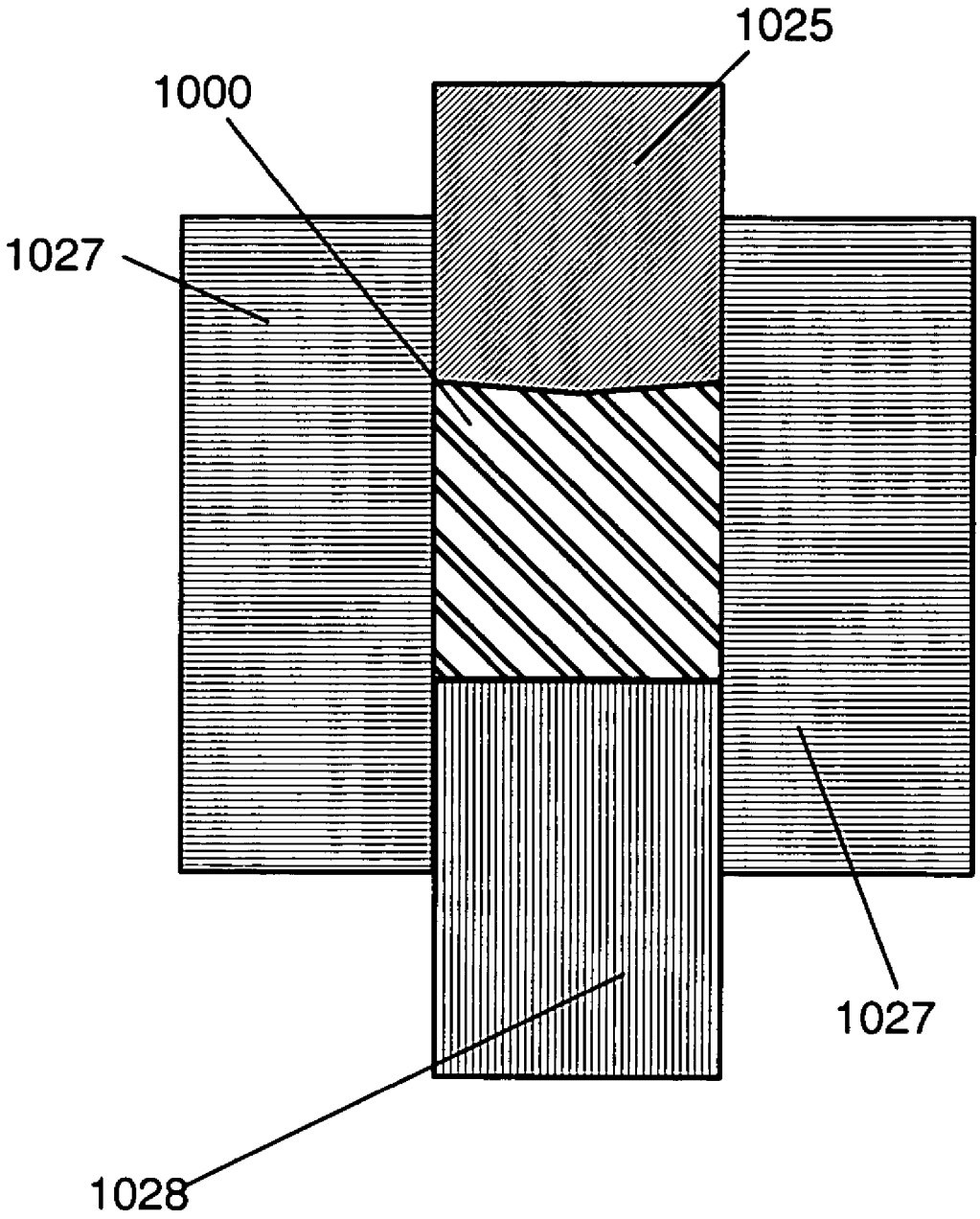
FIG. 36–40 depict an alternative method of fabricating a leakdown plunger.

FIGS. 36 to 40 illustrate an alternative method of fabricating a leakdown plunger. FIG. 36 depicts a metal wire or metal rod 1000 drawn to size. The ends of the wire or rod 1000 are squared off through the use of a first punch 1025, a first die 1027, and a first knock out pin 1028.

Figure 37:
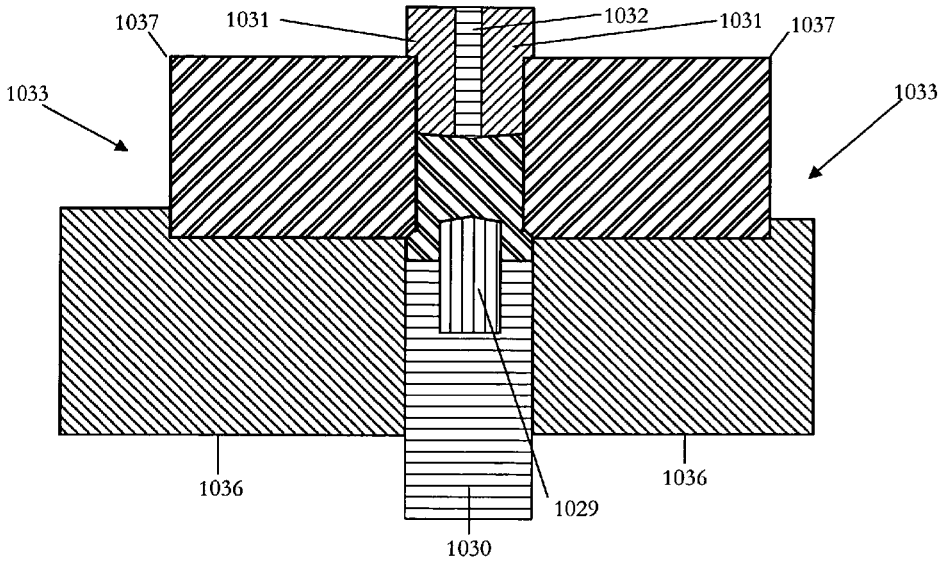

As depicted in FIG. 37, the fabrication of the first plunger opening 231, the second plunger opening 232, and the outer plunger surface 280 is preferably commenced through use of a punch pin 1029, a first punch stripper sleeve 1030, second knock out pin 1031, a stripper pin 1032, and a second die 1033. The first plunger opening 231 is fabricated through use of the second knock out pin 1031. The stripper pin 1032 is used to remove the second knock out pin 1031 from the first plunger opening 231.

The second plunger opening 232 is fabricated, at least in part, through the use of the punch pin 1029. A first punch stripper sleeve 1034 is used to remove the punch pin 1029 from the second plunger opening 232. The outer plunger surface 280 is fabricated, at least in part, through the use of a second die 1033. The second die 1033 is composed of a second die top 1036 and a second die rear 1037.

Figure 38:
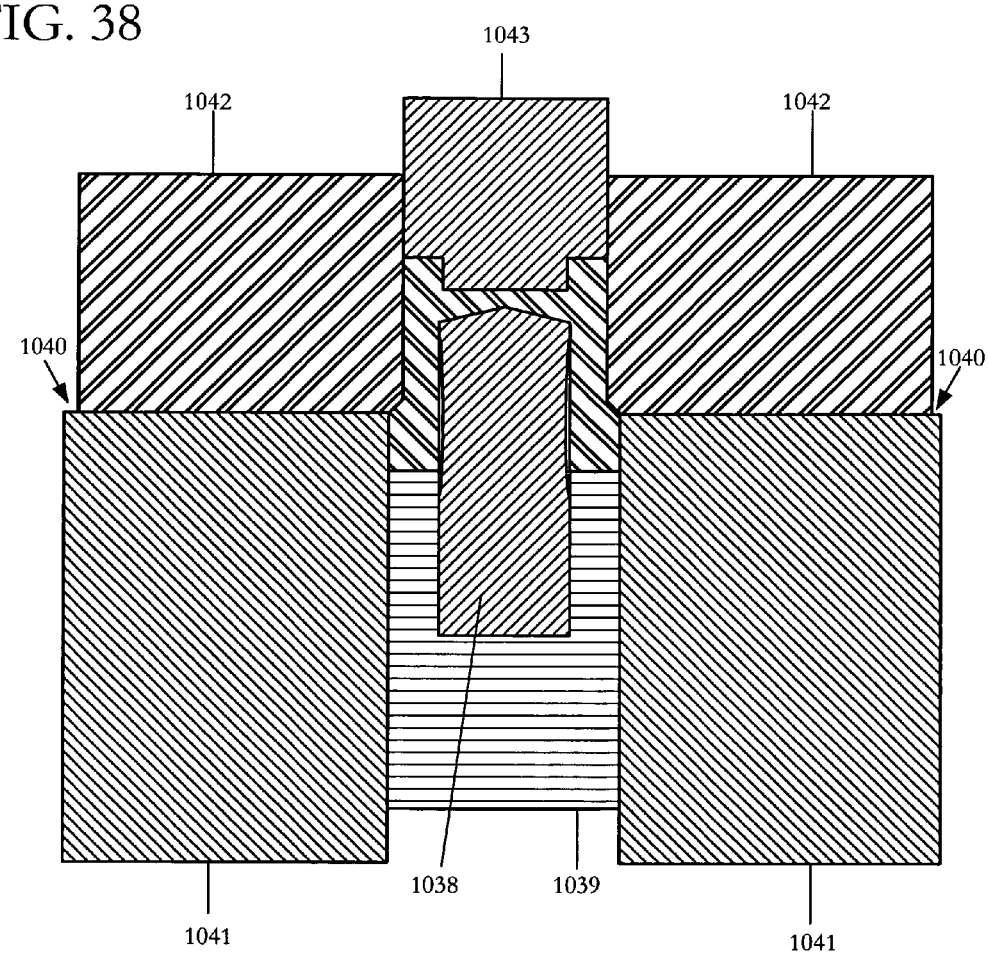

FIG. 38 depicts the forging of the inner plunger surface 250. As depicted, the inner plunger surface 250 is forged through the use of an extrusion punch 1038. A second punch stripper sleeve 1039 is used to remove the extrusion punch 1038 from the inner plunger surface 250.

Those skilled in the art will appreciate that it is advantageous to preserve the previous forging of the first plunger opening 231 and the outer plunger surface 280. A third knock out pin 1043 is used to preserve the previous forging operations on the first plunger opening 231. A third die 1040 is used to preserve the previous forging operations on the outer plunger surface 280. As depicted in FIG. 38, the third die 1040 is composed of a third die top 1041 and a third die rear 1042.

Figure 39:
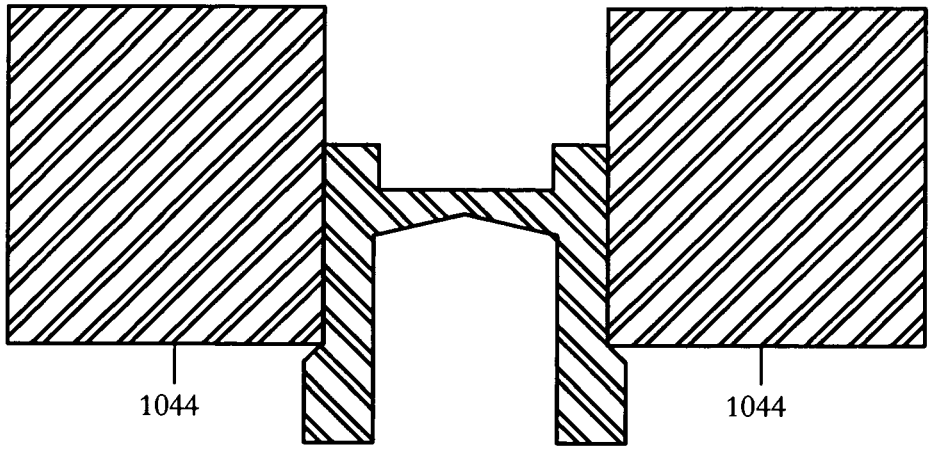

As depicted in FIG. 39, a sizing die 1044 is used in fabricating the second inner conical plunger surface 254 and the second inner cylindrical plunger surface 255. The sizing die 1044 is run along the outer plunger surface 280 from the first plunger opening 231 to the second plunger opening 232. This operation results in metal flowing through to the inner plunger surface 250.

Figure 40:
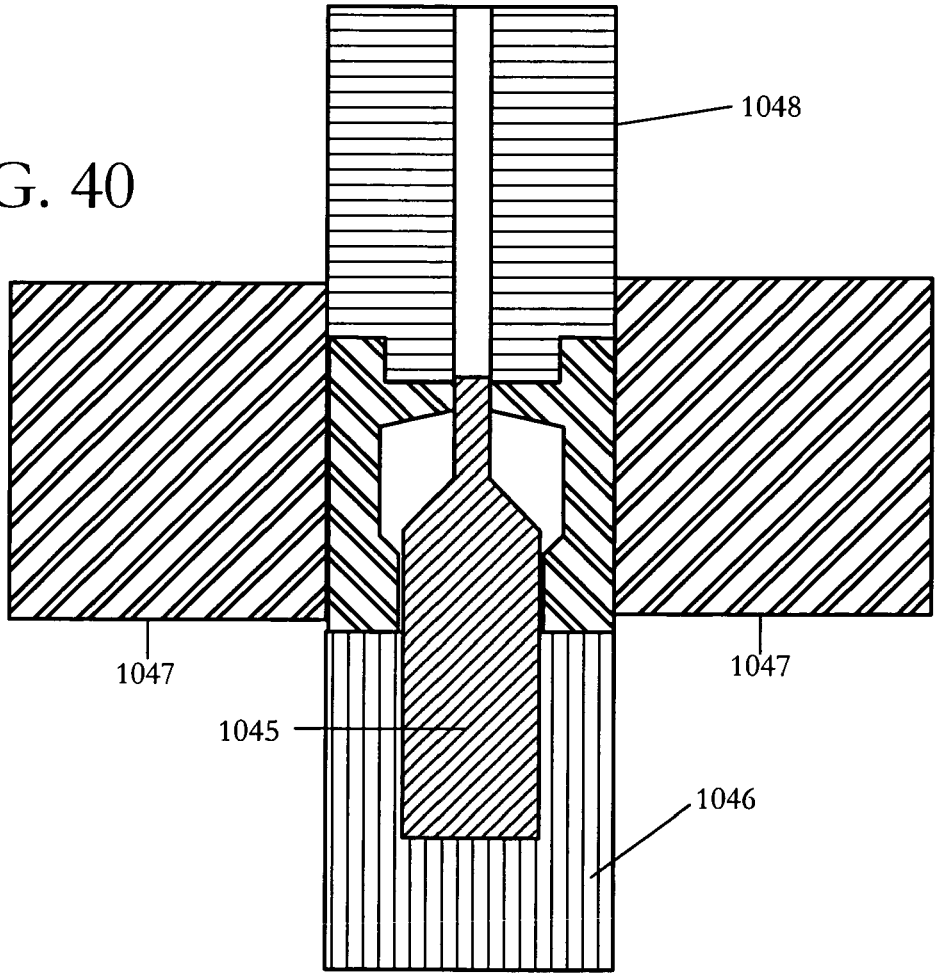
Figure 41:
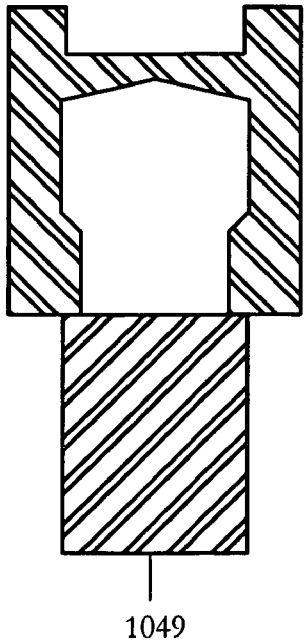
FIG. 41 depicts a step in an alternative method of fabricating a leakdown plunger.

As shown in FIG. 40, the plunger hole 236 is fabricated through use of a piercing punch 1045 and a stripper sleeve 1046. The stripper sleeve 1046 is used in removing the piercing punch 1045 from the plunger hole 236. To assure that other forging operations are not affected during the fabrication of the plunger hole 236, a fourth die 1047 is used around the outer plunger surface 280 and a tool insert 1048 is used at the first plunger opening 231.

Figure 42:
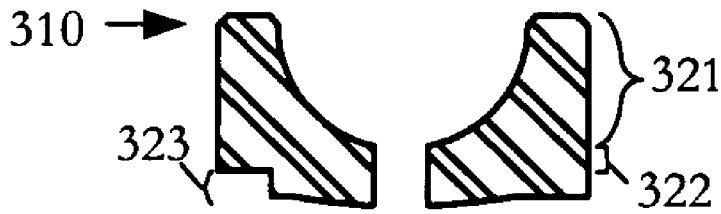
FIG. 42 depicts a preferred embodiment of a socket.

Those skilled in the art will appreciate that further desirable finishing may be accomplished through machining. For example, an undercut plunger surface 282 may be fabricated and the second plunger opening 232 may be enlarged through machining. Alternatively, as depicted in FIG. 42, a shave punch 1049 may be inserted into the second plunger opening 232 and plow back excess material.

Figure 43:
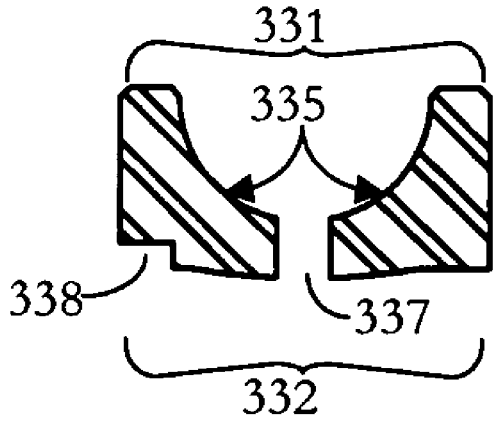
FIG. 43 depicts a preferred embodiment of a socket.
Figure 44:
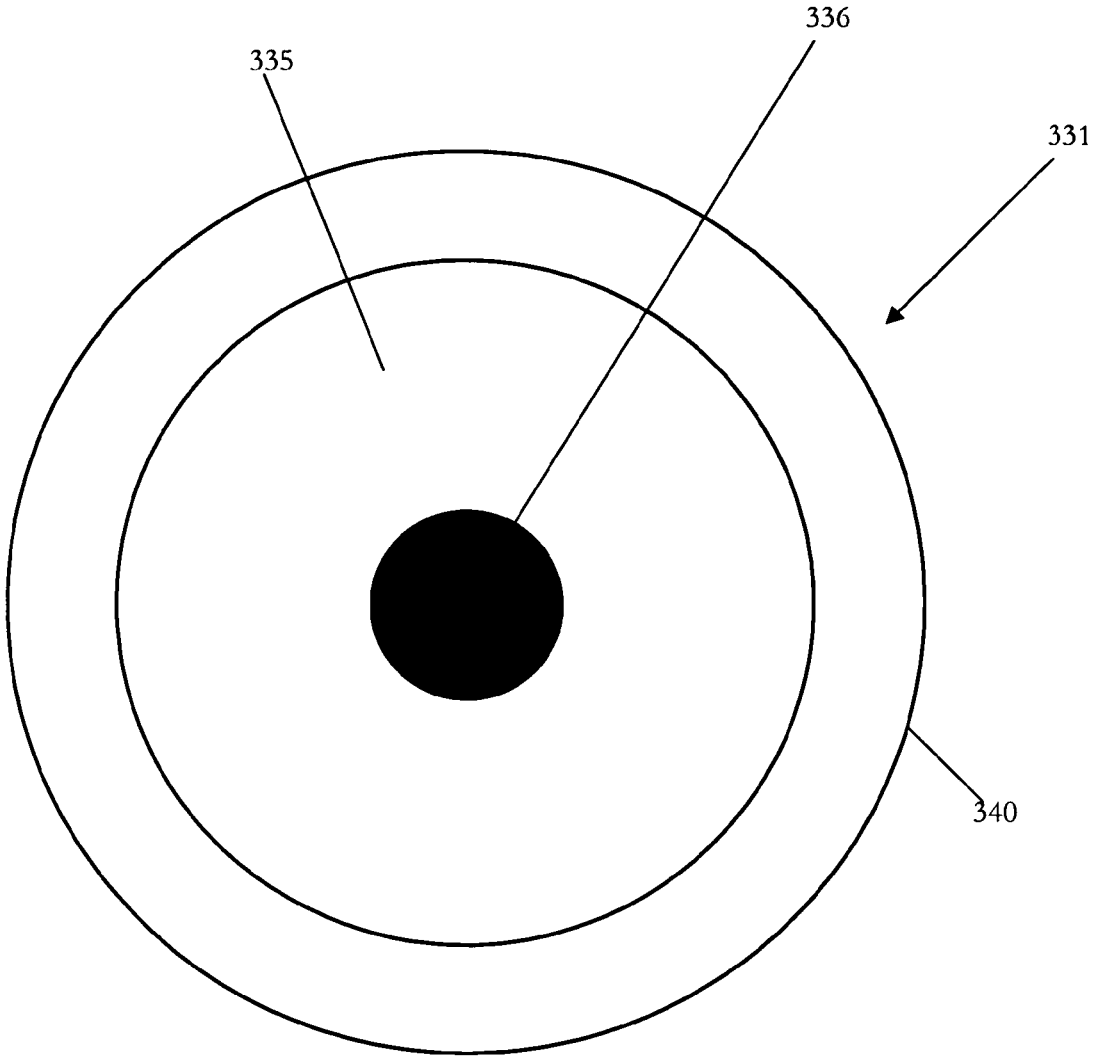
FIG. 44 depicts the top view of a surface of a socket.

Turning now to FIG. 7, a plurality of inserts are shown within the adjusting body 10. As depicted therein, a socket 310 is preferably located within the adjusting body 10. FIGS. 42, 43, and 44, show a socket 310 of the preferred embodiment. The socket 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 310 is composed of pearlitic material. According to still another aspect of the present invention, the socket 310 is composed of austenitic material. According to another aspect of the present invention, the metal is a ferritic material.

The socket 310 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 42 depicts a cross-sectional view of the socket 310 composed of a plurality of socket elements. FIG. 42 shows the socket, generally designated 310. The socket 310 functions to accept a liquid, such as a lubricant and is provided with a plurality of surfaces and passages. Referring now to FIG. 44, the first socket surface 331 functions to accommodate an insert, such as, for example, a push rod 396.

The socket 310 of the preferred embodiment is fabricated from a single piece of metal wire or rod and is described herein as a plurality of socket elements. As shown in FIG. 42, the socket 310 includes a first hollow socket element 321, a second hollow socket element 322, and a third hollow socket element 323. As depicted in FIG. 42 the first hollow socket element 321 is located adjacent to the second socket element 322. The second hollow socket element 322 is located adjacent to the third hollow socket element 323.

The first hollow socket element 321 functions to accept an insert, such as a push rod. The third hollow socket element 323 functions to conduct fluid. The second hollow socket element 322 functions to fluidly link the first hollow socket element 321 with the third hollow socket element 323.

Referring now to FIG. 43 the socket 310 is provided with a plurality of outer surfaces and inner surfaces. FIG. 43 depicts a cross sectional view of the socket 310 of the preferred embodiment of the present invention. As shown in FIG. 43, in the preferred embodiment of the present invention the socket 310 is provided with a first socket surface 331. The first socket surface 331 is configured to accommodate an insert. The preferred embodiment is also provided with a second socket surface 332. The second socket surface 332 is configured to cooperate with an engine workpiece.

FIG. 44 depicts a top view of the first socket surface 331. As shown in FIG. 44, the first socket surface 331 is provided with a push rod cooperating surface 335 defining a first socket hole 336. Preferably, the push rod cooperating surface 335 is concentric relative to the outer socket surface 340; however, such concentricity is not necessary.

In the embodiment depicted in FIG. 44, the first socket hole 336 fluidly links the first socket surface 331 with a socket passage 337 (shown in FIG. 43). The socket passage 337 is shaped to conduct fluid, preferably a lubricant. In the embodiment depicted in FIG. 43, the socket passage 337 is cylindrically shaped; however, those skilled in the art will appreciate that the socket passage 337 may assume any shape so long as it is able to conduct fluid.

Figure 45:
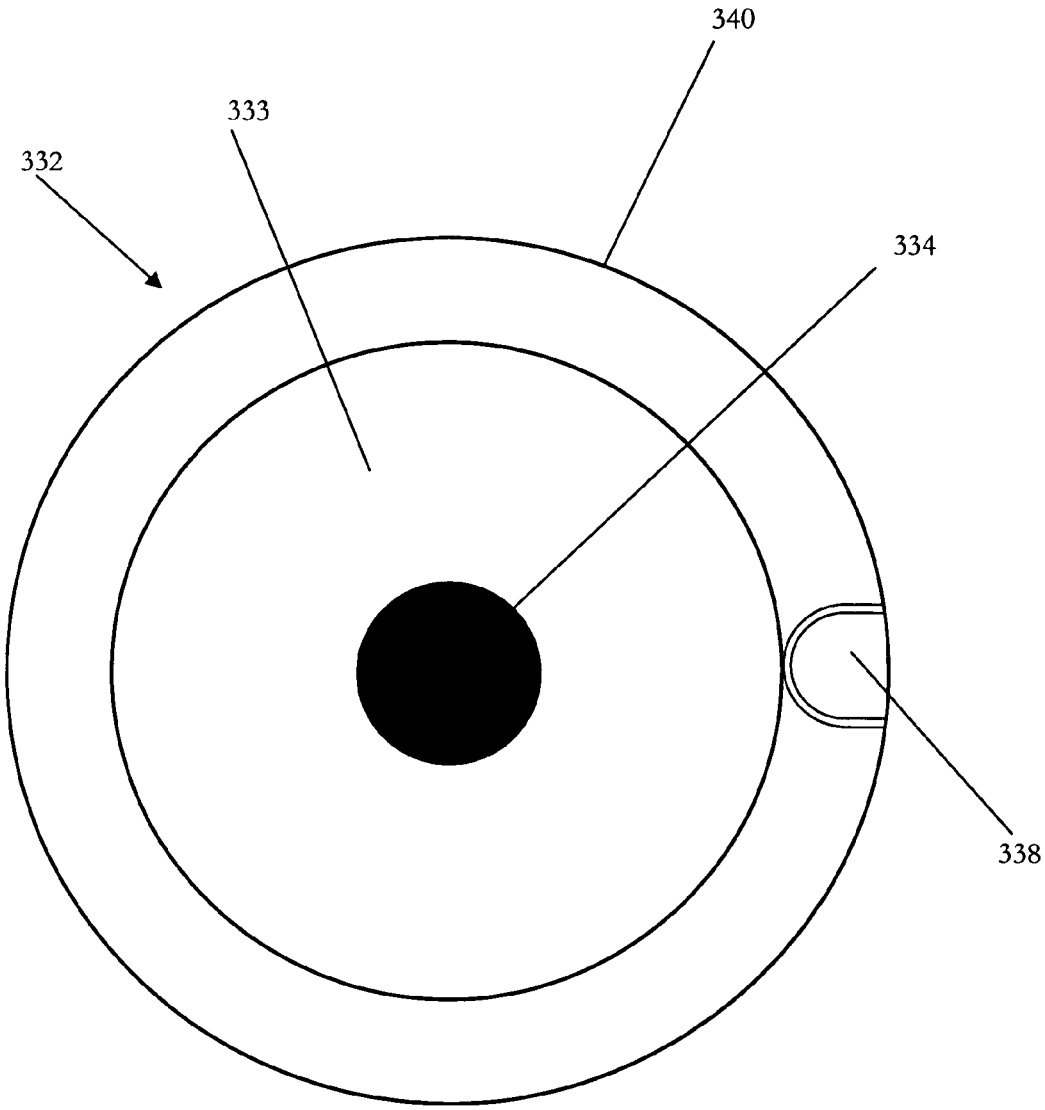
FIG. 45 depicts the top view of another surface of a socket.

FIG. 45 depicts a top view of the second socket surface 332. The second socket surface is provided with a plunger reservoir passage 338. The plunger reservoir passage 338 is configured to conduct fluid, preferably a lubricant. As depicted in FIG. 45, the plunger reservoir passage 338 of the preferred embodiment is generally cylindrical in shape; however, those skilled in the art will appreciate that the plunger reservoir passage 338 may assume any shape so long as it conducts fluid.

The second socket surface 332 defines a second socket hole 334. The second socket hole 334 fluidly links the second socket surface 332 with socket passage 337. The second socket surface 332 is provided with a curved socket surface 333. The curved socket surface 333 is preferably concentric relative to the outer socket surface 340. However, those skilled in the art will appreciate that it is not necessary that the second socket surface 332 be provided with a curved socket surface 333 or that the curved socket surface 333 be concentric relative to the outer socket surface 340. The second socket surface 332 may be provided with any surface, and the curved socket surface 333 of the preferred embodiment may assume any shape so long as the second socket surface 332 cooperates with the opening of an engine workpiece.

Figure 46:
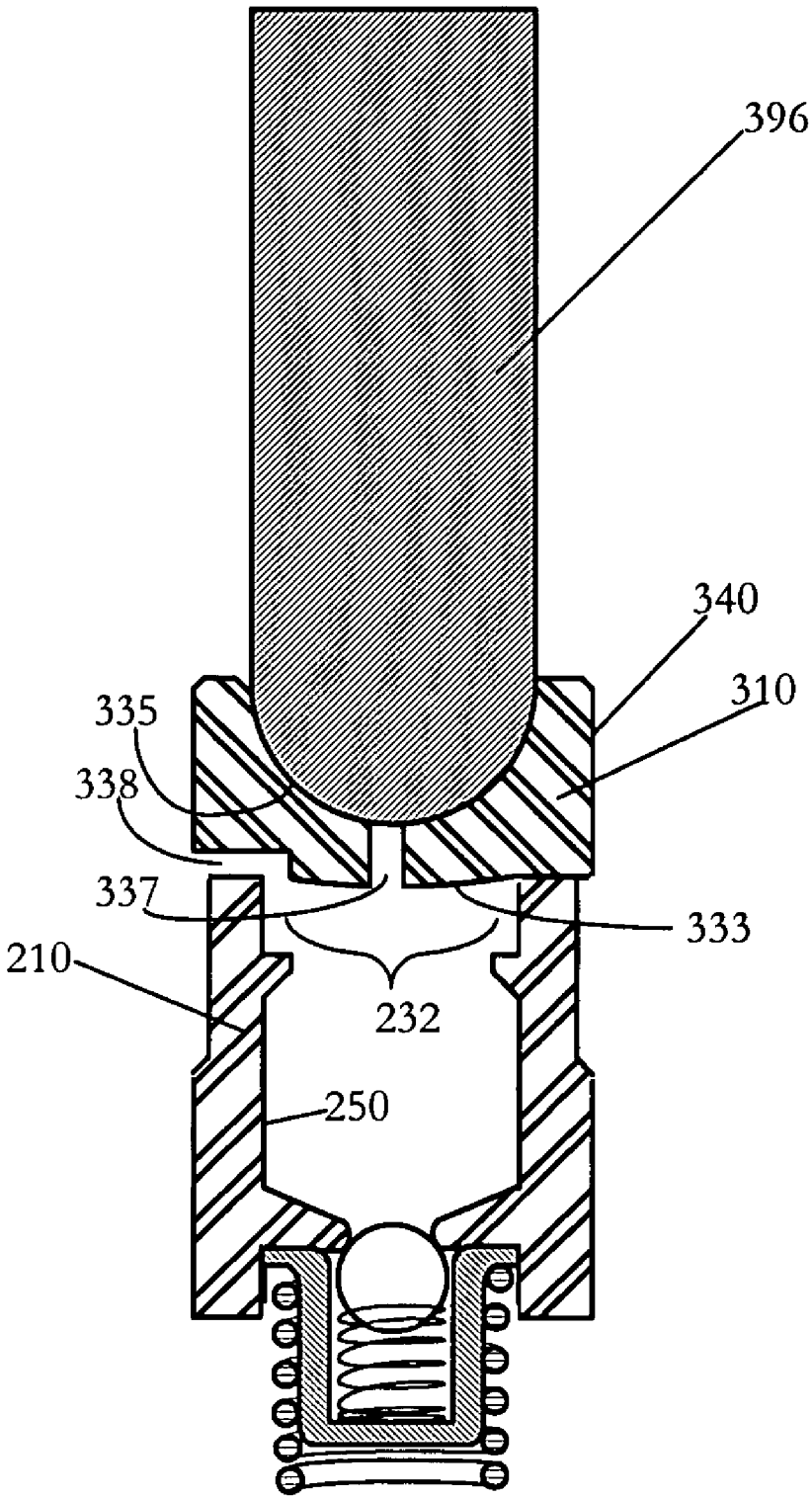
FIG. 46 depicts an embodiment of a socket accommodating an engine work piece.

Referring now to FIG. 46, the first socket surface 331 is depicted accommodating an insert. As shown in FIG. 46, that insert is a push rod 396. The second socket surface 332 is further depicted cooperating with an engine workpiece. Those skilled in the art will appreciate that the engine workpiece can be a leakdown plunger, such as that disclosed in Applicants' "Leakdown Plunger," application Ser. No. 10/274,519 filed on Oct. 18, 2002. As depicted in FIG. 46, in the preferred embodiment the engine workpiece is the leakdown plunger 210. Those skilled in the art will appreciate that push rods other than the push rod 396 shown herein can be used without departing from the scope and spirit of the present invention. Furthermore, those skilled in the art will appreciate that leakdown plungers other than leakdown plunger 210 and those disclosed in Applicants' "Leakdown Plunger," application Ser. No. 10/274,519 can be used without departing from the scope and spirit of the present invention.

As depicted in FIG. 46, the curved socket surface 333 preferably cooperates with the second plunger opening 232 of the leakdown plunger 210. According to one aspect of the present invention, the curved socket surface 333 preferably corresponds to the second plunger opening 232 of the leakdown plunger 210. According to another aspect of the present invention, the curved socket surface 333 preferably provides a closer fit between the second socket surface 332 of the socket 310 and second plunger opening 232 of the leakdown plunger 210.

In the socket 310 depicted in FIG. 46, a socket passage 337 is provided. The socket passage 337 preferably functions to lubricate the push rod cooperating surface 335. The embodiment depicted in FIG. 46 is also provided with a plunger reservoir passage 338. The plunger reservoir passage 338 is configured to conduct fluid, preferably a lubricant.

The plunger reservoir passage 338 performs a plurality of functions. According to one aspect of the present invention, the plunger reservoir passage 338 fluidly links the second plunger opening 232 of the leakdown plunger 210 and the outer socket surface 340 of the socket 310. According to another aspect of the present invention, the plunger reservoir passage 338 fluidly links the inner plunger surface 250 of the leakdown plunger 210 and the outer socket surface 340 of the socket 310.

Those skilled in the art will appreciate that the plunger reservoir passage 338 can be extended so that it joins socket passage 337 within the socket 310. However, it is not necessary that the socket passage 337 and plunger reservoir passage 338 be joined within the socket 310. As depicted in FIG. 46, the plunger reservoir passage 338 of an embodiment of the present invention is fluidly linked to socket passage 337. Those skilled in the art will appreciate that the outer socket surface 340 is fluidly linked to the first socket surface 331 in the embodiment depicted in FIG. 46.

Figure 47:
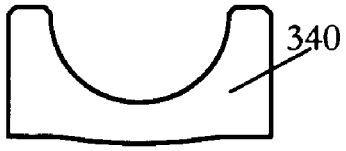
FIG. 47 depicts an outer surface of an embodiment of a socket.

As depicted in FIG. 47, socket 310 of the preferred embodiment is provided with an outer socket surface 340. The outer socket surface 340 is configured to cooperate with the inner surface of an engine workpiece. The outer socket surface 340 of the presently preferred embodiment is cylindrically shaped. However, those skilled in the art will appreciate that the outer socket surface 340 may assume any shape so long as it is configured to cooperate with the inner surface of an engine workpiece.

Figure 48:
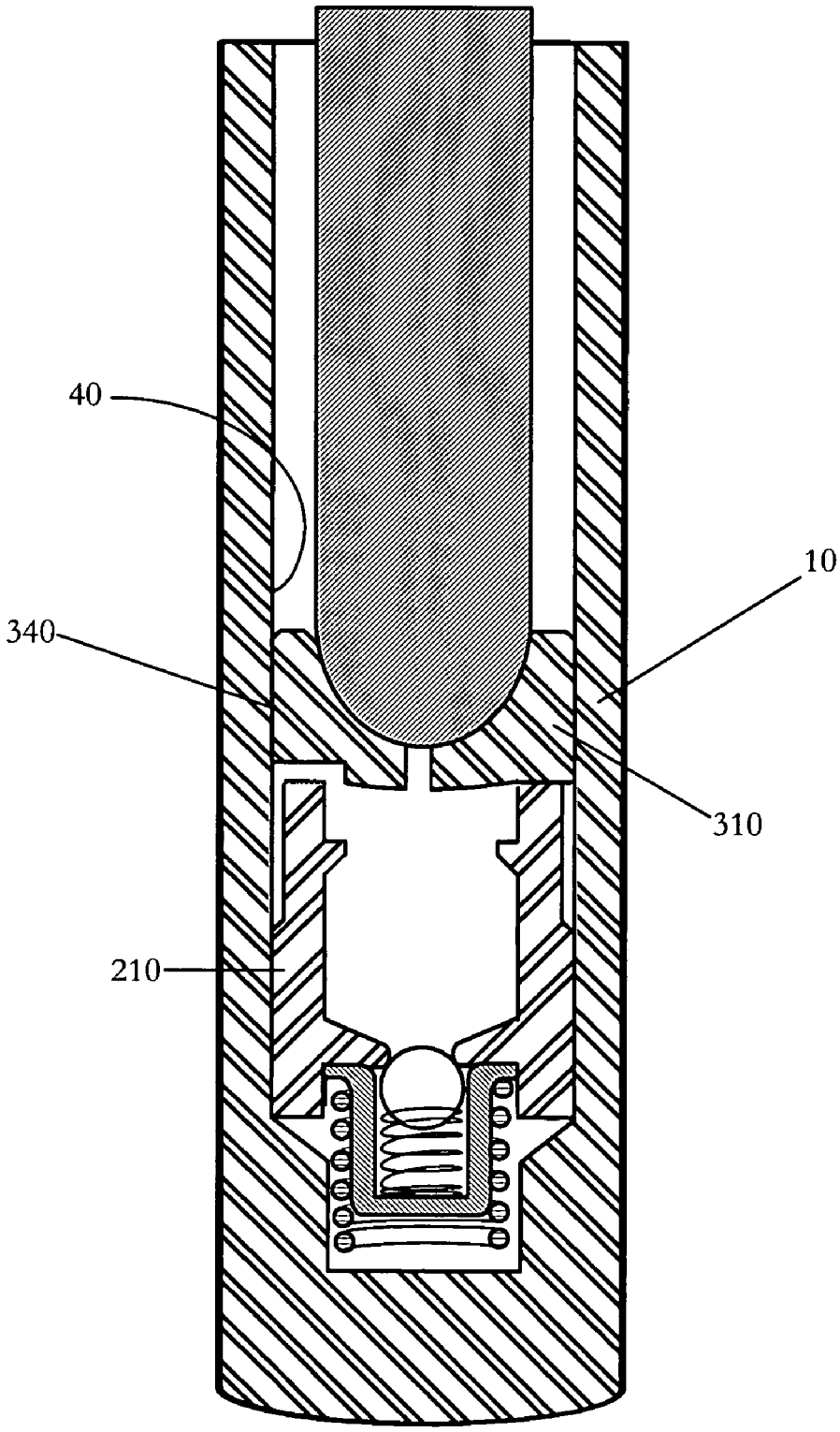
FIG. 48 depicts an embodiment of a socket cooperating with an engine work piece.

FIG. 48 depicts the outer socket surface 340 configured to cooperate with the inner surface of an engine workpiece. The outer socket surface 340 is configured to cooperate with a lash adjuster body. As shown in FIG. 48, the outer socket surface 340 is preferably configured to cooperate with the inner surface 40 of the lash adjuster 10.

The adjusting body 10, with the socket 310 of the present invention located therein, may be inserted into a roller follower body, such as that disclosed in Applicants' "Roller Follower Body," application Ser. No. 10/316,261 filed on Oct. 18, 2002. As shown in FIG. 49, in the preferred embodiment the adjusting body 10, with the socket 310 of the present invention located therein, is inserted into the valve lifter body 110.

Referring now to FIG. 50 to FIG. 54, the presently preferred method of fabricating a socket 310 is disclosed. FIG. 50 to 54 depict what is known in the art as a "slug progression" that shows the fabrication of the present invention from a rod or wire to a finished or near-finished socket body. In the slug progression shown herein, pins are shown on the punch side; however, those skilled in the art will appreciate that the pins can be switched to the die side without departing from the scope of the present invention.

The socket 310 of the preferred embodiment is forged with use of a National®750 parts former machine. However, those skilled in the art will appreciate that other part formers, such as, for example, a Waterbury machine can be used. Those skilled in the art will further appreciate that other forging methods can be used as well.

The process of forging an embodiment of the present invention begins with a metal wire or metal rod 2000 which is drawn to size. The ends of the wire or rod are squared off. As shown in FIG. 50, this is accomplished through the use of a first punch 2001, a first die 2002, and a first knock out pin 2003.

After being drawn to size, the wire or rod 2000 is run through a series of dies or extrusions. As depicted in FIG. 51, the fabrication of the first socket surface 331, the outer socket surface, and the third surface is preferably commenced through use of a second punch 2004, a second knock out pin 2005, and a second die 2006. The second punch 2004 is used to commence fabrication of the first socket surface 331. The second die 2006 is used against the outer socket surface 340. The second knock out pin 2005 is used to commence fabrication of the second socket surface 332.

FIG. 52 depicts the fabrication of the first socket surface 331, the second socket surface 332, and the outer socket surface 340 through use of a third punch 2007, a first stripper sleeve 2008, a third knock out pin 2009, and a third die 2010. The first socket surface 331 is fabricated using the third punch 2007. The first stripper sleeve 2008 is used to remove the third punch 2007 from the first socket surface 331. The second socket surface 332 is fabricated through use of the third knock out pin 2009, and the outer socket surface 340 is fabricated through use of the third die 2010.

As depicted in FIG. 53, the fabrication of the socket passage 337 and plunger reservoir passage 338 is commenced through use of a punch pin 2011 and a fourth knock out pin 2012. A second stripper sleeve 2013 is used to remove the punch pin 2011 from the first socket surface 331. The fourth knock out pin 2012 is used to fabricate the plunger reservoir passage 338. A fourth die 2014 is used to prevent change to the outer socket surface 340 during the fabrication of the socket passage 337 and plunger reservoir passage 338.

Referring now to FIG. 54, fabrication of socket passage 337 is completed through use of pin 2015. A third stripper sleeve 2016 is used to remove the pin 2015 from the first socket surface 331. A fifth die 2017 is used to prevent change to the outer socket surface 340 during the fabrication of socket passage 337. A tool insert 2018 is used to prevent change to the second socket surface 332 and the plunger reservoir passage 338 during the fabrication of socket passage 337.

Those skilled in the art will appreciate that further desirable finishing may be accomplished through machining. For example, socket passage 337 and plunger reservoir passage 338 may be enlarged and other socket passages may be drilled. However, such machining is not necessary.

While this invention has been particularly shown and described with references to preferred embodiments thereof, it will be understood by those skilled in the art that various changes in form and details may be made therein without departing from the spirit and scope of the invention as defined by the appended claims.

We claim:

1. An assembly, comprising:

a) an adjusting body that includes an axis and that has, at least in part, been cold formed to provide a cavity;

b) the cavity of the adjusting body has, at least in part, been machined to provide an inner surface that includes an annular surface that is located between a first cylindrical surface and a second cylindrical surface;

c) the annular surface has been machined so that the annular surface is oriented to be generally orthogonal to the axis of the adjusting body;

d) a valve lifter body that has been cold formed to provide a first lifter cavity that includes a first inner lifter surface and a second lifter cavity;

e) the valve lifter body is provided with an axis, a first end that includes a first opening, a second end that includes a second opening, and an outer lifter surface that encloses the first lifter cavity and the second lifter cavity;

f) the first inner lifter surface of the first lifter cavity has, at least in part, been cold formed into the first end of the valve lifter body to provide a first wall, a second wall, a third wall, a fourth wall, a first angled wall, a second angled wall, a third angled wall, and a fourth angled wall that extend axially into the valve lifter body from the first end and a first angled lifter surface, a second angled lifter surface, a third angled lifter surface, and a fourth angled lifter surface that are generally oriented to be at angle relative to the plane of the annular surface of the adjusting body;

g) the first angled lifter surface has been cold formed to extend from the first angled wall and is located adjacent to the first wall and a first curved surface;

h) the second angled lifter surface has been cold formed to extend from the fourth angled wall and is located adjacent to the first wall and a second curved surface;

i) the third angled lifter surface has been cold formed to extend from the second angled wall and is located adjacent to the second wall; and j) the fourth angled lifter surface has been cold formed to extend from the third angled wall and is located adjacent to the second wall.

2. The assembly of claim 1 wherein at least one of the angled surfaces of the valve lifter body is generally oriented to be at an angle relative to the annular surface of the adjusting body, the angle measuring between twenty-five and about ninety degrees.

3. The assembly of claim 1 wherein the fourth angled surface has been cold formed to extend from the third angled wall at an angle measuring between 45 degrees and 65 degrees relative to the annular surface of the adjusting body.

4. The assembly of claim 1 further comprising a combustion engine wherein the valve lifter body is located within the combustion engine and functions to operate a valve.

5. The assembly of claim 1 wherein at least one of the angled surfaces of the valve lifter body is generally oriented to be at an angle relative to the annular surface of the adjusting body, the angle measuring between thirty and about seventy-five degrees.

6. The assembly of claim 1 further comprising a leakdown plunger that has been fabricated, at least in part, through cold forming.

7. The assembly of claim 1 further comprising a leakdown plunger and a metering socket that have, at least in part, been fabricated through cold forming.

8. An assembly, comprising:

a) an adjusting body that has, at least in part, been cold formed to provide a cavity;

b) a valve lifter body that has been cold formed to provide a first lifter cavity and a second lifter cavity, wherein the first lifter cavity includes a first inner lifter surface;

c) the valve lifter body is provided with a valve lifter axis, a first end that includes a first opening, a second end that includes a second opening; and an outer lifter surface that encloses the first lifter cavity and the second lifter cavity;

d) the adjusting body includes a bottom surface and an axis wherein the bottom surface is generally oriented to be orthogonal to the valve lifter axis;

e) the first inner lifter surface of the first lifter cavity has, at least in part, been cold formed into the first end of the valve lifter body to provide a fast wall, a second wall, a third wall, a fourth wall, a first angled wall, a second angled wall, a third angled wall, and a fourth angled wall that extend axially into the valve lifter body from the first end and a first angled lifter surface, a second angled lifter surface, a third angled lifter surface, and a fourth angled lifter surface that are generally oriented to be at angle relative to the plane of the bottom surface of the adjusting body;

f) the first angled lifter surface has been cold formed to extend from the first angled wall and is located adjacent to the first wall and a first curved surface;

g) the second angled lifter surface has been cold formed to extend from the fourth angled wall and is located adjacent to the first wall and a second curved surface;

h) the third angled lifter surface has been cold formed to extend from the second angled wall and is located adjacent to the second wall; and i) the fourth angled lifter surface has been cold formed to extend from the third angled wall and is located adjacent to the second wall.

9. The assembly of claim 8 wherein at least one of the angled surfaces of the valve lifter body is generally oriented to be at an angle relative to the bottom surface of the adjusting body, the angle measuring between twenty-five and about ninety degrees.

10. The assembly of claim 8 wherein the fourth angled surface has been cold formed to extend from the third angled wall at an angle measuring between 45 degrees and 65 degrees relative to the bottom surface of the adjusting body.

11. The assembly of claim 8 further comprising a combustion engine wherein the valve lifter body is located within the combustion engine and functions to operate a valve.

12. The assembly of claim 8 wherein at least one of the angled surfaces of the valve lifter body is generally oriented to be at an angle relative to the bottom surface of the adjusting body, the angle measuring between thirty and about seventy-five degrees.

13. The assembly of claim 8 further comprising a leakdown plunger that has been fabricated, at least in part, through cold forming.

14. The assembly of claim 8 further comprising a leakdown plunger and a metering socket that have, at least in part, been fabricated through cold forming.

15. An assembly, comprising:

a) an adjusting body that has, at least in part, been cold formed to provide a cavity;

b) a valve lifter body that has been cold formed to provide a first lifter cavity and a second lifter cavity, wherein the first lifter cavity includes a first inner lifter surface;

c) the valve lifter body is provided with a valve lifter axis, a first end that includes a first opening, a second end that includes a second opening, and an outer lifter surface that encloses the first lifter cavity and the second lifter cavity;

d) the adjusting body includes a bottom surface and an axis wherein the bottom surface is generally oriented to be orthogonal to the valve lifter axis;

e) the first inner lifter surface of the first lifter cavity has, at least in part, been cold formed into the first end of the valve lifter body to provide a first wall, a second wall, a third wall, a fourth wall, a first angled wall, a second angled wall, a third angled wall, and a fourth angled wall that extend axially into the valve lifter body from the first end and a first angled lifter surface, a second angled lifter surface, a third angled lifter surface, and a fourth angled lifter surface that are generally oriented to be at angle relative to the plane of the bottom surface of the adjusting body.

16. The assembly of claim 15 wherein the first inner surface includes:

a) a first curved surface;

b) a second curved surface;

c) the fourth wall extends axially into the valve lifter body from the first opening and terminates, at least in part, at the first curved surface; and d) the third wall extends into the valve lifter body from the first opening and terminates, at least in part, at the second curved surface.

17. The assembly of claim 15 wherein at least one of the angled surfaces of the valve lifter body is generally oriented to be at an angle relative to the bottom surface of the adjusting body, the angle measuring between twenty-five and about ninety degrees.

18. The assembly of claim 15 wherein the fourth angled surface has been cold formed to extend from the third angled wall at an angle measuring between 45 degrees and 65 degrees relative to the bottom surface of the adjusting body.

19. The assembly of claim 15 further comprising a combustion engine wherein the valve lifter body is located within the combustion engine and functions to operate a valve.

20. The assembly of claim 15 wherein at least one of the angled surfaces of the valve lifter body is generally oriented to be at an angle relative to the bottom surface of the adjusting body, the angle measuring between thirty and about seventy-five degrees.

21. The assembly of claim 15, further comprising a leakdown plunger that has been fabricated, at least in part, through cold forming.

22. The assembly of claim 15 further comprising a leakdown plunger and a metering socket that have, at least in part, been fabricated through cold forming.

* * * * *